US010167595B2

(12) United States Patent
Sze et al.

(10) Patent No.: US 10,167,595 B2
(45) Date of Patent: Jan. 1, 2019

(54) METHOD OF CREPING A CELLULOSIC SHEET USING A MULTILAYER CREPING BELT HAVING OPENINGS TO MAKE PAPER PRODUCTS, AND PAPER PRODUCTS MADE USING A MULTILAYER CREPING BELT HAVING OPENINGS

(71) Applicant: GPCP IP HOLDINGS LLC, Atlanta, GA (US)

(72) Inventors: Daniel H. Sze, Appleton, WI (US); Hung Liang Chou, Neenah, WI (US); Xiaolin Fan, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 15/794,030

(22) Filed: Oct. 26, 2017

(65) Prior Publication Data

US 2018/0044860 A1 Feb. 15, 2018

Related U.S. Application Data

(62) Division of application No. 14/865,443, filed on Sep. 25, 2015, now Pat. No. 9,863,095.

(Continued)

(51) Int. Cl.
*B31F 1/16* (2006.01)
*B31F 1/12* (2006.01)

(Continued)

(52) U.S. Cl.
CPC ..... *D21H 27/40* (2013.01); *B31F 1/16* (2013.01); *D21F 11/006* (2013.01); *D21H 11/04* (2013.01);

(Continued)

(58) Field of Classification Search
CPC .... D21H 27/007; D21H 27/002; D21H 11/00; D21H 11/06; D21H 27/02; D21H 27/40;

(Continued)

(56) References Cited

U.S. PATENT DOCUMENTS 4,206,258 A 6/1980 Balcar
4,446,187 A 5/1984 Eklund (Continued)

FOREIGN PATENT DOCUMENTS

CA 2751162 A1 * 8/2010 ..... B31F 1/126
CA 2958904 A1 * 3/2016

(Continued)

OTHER PUBLICATIONS

International Search Report dated Dec. 10, 2015, in corresponding International Patent Application No. PCT/US2015/052390.

(Continued)

*Primary Examiner* — Jose A Fortuna
(74) *Attorney, Agent, or Firm* — Laura L. Bozek

(57) ABSTRACT

A method of creping a cellulosic sheet and a creped web made by a creping process. The method includes preparing a nascent web from an aqueous papermaking furnish, depositing and creping the nascent web on a multilayer creping belt that includes (i) a first layer made from a polymeric material having a plurality of openings, and (ii) a second layer attached to a surface of the first layer, with the nascent web being deposited on the first layer, and applying a vacuum to the creping belt such that the nascent web is drawn into the plurality of openings, but not drawn into the second layer.

20 Claims, 24 Drawing Sheets

Related U.S. Application Data

(60) Provisional application No. 62/055,261, filed on Sep. 25, 2014.

(51) Int. Cl.
*D21H 27/40* (2006.01)
*D21H 11/04* (2006.01)
*D21H 27/00* (2006.01)
*D21F 11/00* (2006.01)

(52) U.S. Cl.
CPC ..... *D21H 27/002* (2013.01); *D21H 27/005* (2013.01); *D21H 27/007* (2013.01)

(58) Field of Classification Search
CPC ..... D21H 27/30; D21H 11/04; D21H 27/005; B31F 1/122; B31F 1/126; B31F 1/16; Y10T 428/24455; Y10T 428/24479; Y10T 428/24628; Y10S 162/90
See application file for complete search history.

(56) References Cited

U.S. PATENT DOCUMENTS 4,529,480 A 7/1985 Trokhan
4,541,895 A 9/1985 Albert
5,098,522 A 3/1992 Smurkoski et al.
5,245,025 A 9/1993 Trokhan et al.
5,260,171 A 11/1993 Smurkoski et al.
5,277,761 A 1/1994 Van Phan et al.
5,356,364 A 10/1994 Veith et al.
5,364,504 A 11/1994 Smurkoski et al.
5,431,786 A 7/1995 Rasch et al.
5,443,691 A 8/1995 Phan et al.
5,496,624 A 3/1996 Stelljes, Jr. et al.
5,503,715 A 4/1996 Trokhan et al.
5,505,818 A 4/1996 Hermans et al.
5,527,428 A 6/1996 Trokhan et al.
5,549,790 A 8/1996 Van Phan
5,556,509 A 9/1996 Trokhan et al.
5,609,725 A 3/1997 Van Phan
5,628,876 A 5/1997 Ayers et al.
5,654,076 A 8/1997 Trokhan et al.
5,679,222 A * 10/1997 Rasch ..... B29C 35/10 162/348
5,714,041 A 2/1998 Ayers et al.
5,776,307 A 7/1998 Ampulski et al.
5,804,281 A 9/1998 Phan et al.
5,814,190 A 9/1998 Van Phan
5,820,730 A 10/1998 Phan et al.
5,840,411 A 11/1998 Stelljes, Jr. et al.
5,843,279 A 12/1998 Phan et al.
5,855,739 A 1/1999 Ampulski et al.
5,893,965 A 4/1999 Trokhan et al.
5,900,122 A 5/1999 Huston
5,904,811 A 5/1999 Ampulski et al.
5,906,710 A 5/1999 Trokhan
5,948,210 A 9/1999 Huston
6,039,839 A 3/2000 Trokhan et al.
6,103,067 A 8/2000 Stelljes, Jr. et al.
6,110,324 A 8/2000 Trokhan et al.
6,117,270 A 9/2000 Trokhan
6,136,146 A 10/2000 Phan et al.
6,146,494 A 11/2000 Seger et al.
6,171,447 B1 1/2001 Trokhan
6,193,847 B1 2/2001 Trokhan
6,368,465 B1 4/2002 Stelljes, Jr. et al.
6,436,240 B1 8/2002 Jeffrey
6,447,642 B1 9/2002 Phan et al.
6,464,831 B1 10/2002 Trokhan et al.
6,540,880 B1 4/2003 Trokhan et al.
6,558,510 B1 5/2003 Edwards et al.
6,576,090 B1 6/2003 Trokhan et al.
6,576,091 B1 6/2003 Cabell et al.
6,585,856 B2 7/2003 Zwick et al.
6,610,173 B1 8/2003 Lindsay et al.
6,660,362 B1 12/2003 Lindsay et al.
6,673,202 B2 1/2004 Burazin et al.
6,752,890 B2 6/2004 Paquin
6,902,787 B2 6/2005 Baker
7,005,044 B2 2/2006 Kramer et al.
7,014,735 B2 3/2006 Kramer et al.
7,067,038 B2 6/2006 Trokhan et al.
7,118,647 B2 10/2006 Cabell et al.
7,144,479 B2 12/2006 Davis et al.
7,144,480 B2 12/2006 Davis
7,166,195 B2 1/2007 Hawes
7,265,067 B1 9/2007 Phan
7,314,663 B2 1/2008 Stelljes, Jr. et al.
7,314,664 B2 1/2008 Stelljes, Jr. et al.
7,314,665 B2 1/2008 Stelljes, Jr. et al.
7,332,451 B2 2/2008 Bamholtz et al.
7,354,502 B2 4/2008 Polat et al.
7,396,436 B2 7/2008 Trokhan et al.
7,494,563 B2 2/2009 Edwards et al.
7,550,059 B2 6/2009 Van Phan et al.
7,754,049 B2 7/2010 Edwards et al.
7,828,931 B2 11/2010 Edwards et al.
D648,137 S 11/2011 Olson et al.
8,152,957 B2 4/2012 Edwards et al.
8,216,427 B2 7/2012 Klerelid et al.
8,293,072 B2 * 10/2012 Super ..... B31F 1/126 162/109
8,366,878 B2 2/2013 Klerelid et al.
8,394,239 B2 3/2013 Eagles et al.
8,398,818 B2 3/2013 Edwards et al.
8,435,381 B2 5/2013 Murray et al.
8,652,300 B2 * 2/2014 Super ..... B31F 1/126 162/109
8,852,397 B2 * 10/2014 Super ..... B31F 1/126 162/109
8,968,516 B2 * 3/2015 Super ..... B31F 1/126 162/109
9,017,517 B2 * 4/2015 Super ..... B31F 1/126 162/109
9,279,219 B2 3/2016 Edwards et al.
9,303,363 B2 * 4/2016 Chou ..... D21H 27/40
9,371,615 B2 6/2016 Super et al.
9,382,663 B2 * 7/2016 Sze ..... D21F 11/006
9,388,534 B2 * 7/2016 Super ..... B31F 1/126
9,404,224 B2 * 8/2016 Chou ..... D21H 27/40
9,453,303 B2 9/2016 Aberg et al.
9,574,306 B2 * 2/2017 Chou ..... D21H 27/40
9,611,591 B2 4/2017 Chou et al.
9,873,980 B2 * 1/2018 Eagles ..... D21F 7/083
9,903,070 B2 * 2/2018 Mourad ..... D21G 9/00
2003/0040242 A1 2/2003 Pike et al.
2004/0154763 A1 8/2004 Polat et al.
2006/0088697 A1 * 4/2006 Manifold ..... D21H 27/02 428/174
2006/0127641 A1 6/2006 Barnholtz et al.
2008/0029235 A1 2/2008 Edwards et al.
2008/0083519 A1 * 4/2008 Kokko ..... D21F 11/14 162/9
2009/0301675 A1 12/2009 Edwards et al.
2010/0119779 A1 5/2010 Ostendorf et al.
2010/0186913 A1 * 7/2010 Super ..... B31F 1/126 162/111
2012/0027997 A1 2/2012 Aberg et al.
2012/0168103 A1 * 7/2012 White ..... D21H 21/146 162/111
2012/0199300 A1 * 8/2012 Edwards ..... D21F 11/006 162/141
2012/0241113 A1 * 9/2012 Super ..... B31F 1/126 162/111
2012/0247698 A1 10/2012 Murray et al.
2012/0267063 A1 10/2012 Klerelid et al.
2014/0352901 A1 * 12/2014 Super ..... B31F 1/126 162/113
2015/0068695 A1 3/2015 Edwards et al.
2015/0129144 A1 5/2015 Super et al.
2015/0129145 A1 * 5/2015 Chou ..... D21H 27/40 162/116

(56) References Cited

U.S. PATENT DOCUMENTS

| | | | | |
|---|---|---|---|---|
| 2015/0129146 | A1* | 5/2015 | Chou | D21H 27/40 162/116 |
| 2015/0152603 | A1* | 6/2015 | Super | B31F 1/126 162/111 |
| 2016/0090692 | A1* | 3/2016 | Eagles | D21F 7/083 162/348 |
| 2016/0090693 | A1* | 3/2016 | Eagles | D21F 7/083 162/348 |
| 2016/0090698 | A1* | 3/2016 | Sze | D21H 11/04 162/101 |
| 2016/0097164 | A1* | 4/2016 | Chou | D21H 27/40 162/116 |
| 2016/0230344 | A1* | 8/2016 | White | D21H 21/146 |
| 2016/0305072 | A1* | 10/2016 | Chou | D21H 27/40 |
| 2016/0355982 | A1* | 12/2016 | Sze | D21H 27/002 |
| 2018/0044860 | A1* | 2/2018 | Sze | D21H 27/005 |
| 2018/0105984 | A1* | 4/2018 | Eagles | D21F 11/14 |

FOREIGN PATENT DOCUMENTS

| | | | | |
|---|---|---|---|---|
| CN | 1723318 | A | 1/2006 | |
| EP | 1 182 293 | A1 | 2/2002 | |
| EP | 2633991 | A1 * | 9/2013 | B31F 1/126 |
| EP | 2391504 | B1 * | 4/2014 | B31F 1/126 |
| EP | 2752289 | A1 * | 7/2014 | B31F 1/126 |
| EP | 2633991 | B1 * | 9/2015 | B31F 1/126 |
| JP | 5680555 | B2 * | 3/2015 | B31F 1/126 |
| JP | 2015-096665 | A | 5/2015 | |
| JP | 5946546 | B2 * | 7/2016 | B31F 1/126 |
| WO | 2010/030298 | A1 | 3/2010 | |
| WO | 2010/068765 | A1 | 6/2010 | |
| WO | WO-2010088359 | A1 * | 8/2010 | B31F 1/126 |
| WO | WO-2016049546 | A1 * | 3/2016 | D21H 11/04 |

OTHER PUBLICATIONS

International Preliminary Report on Patentability dated Mar. 28, 2017, in corresponding International Patent Application No. PCT/US2015/052390.

Colombian Official Action dated Apr. 14, 2017, issued in corresponding Colombian Patent Application No. NC2017/0003340, with an English translation.

Cuban Official Action dated Apr. 18, 2017, issued in corresponding Cuban Patent Application No. 2017-0040, with an English translation.

Garcia, Damien. "Robust smoothing of gridded data in one and higher dimensions with missing values," Computational Statistics and Data Analysis, 54 (2010), pp. 1176-1178.

Office Action dated May 23, 2018, issued in corresponding Colombian Patent Application No. NC2017/0003340.

Office Action dated Jul. 17, 2018, issued in corresponding Chilean Patent Application No. 00701-2017.

Office Action dated Sep. 7, 2018, issued in corresponding Chinese Patent Application No. 201580051598.X.

* cited by examiner

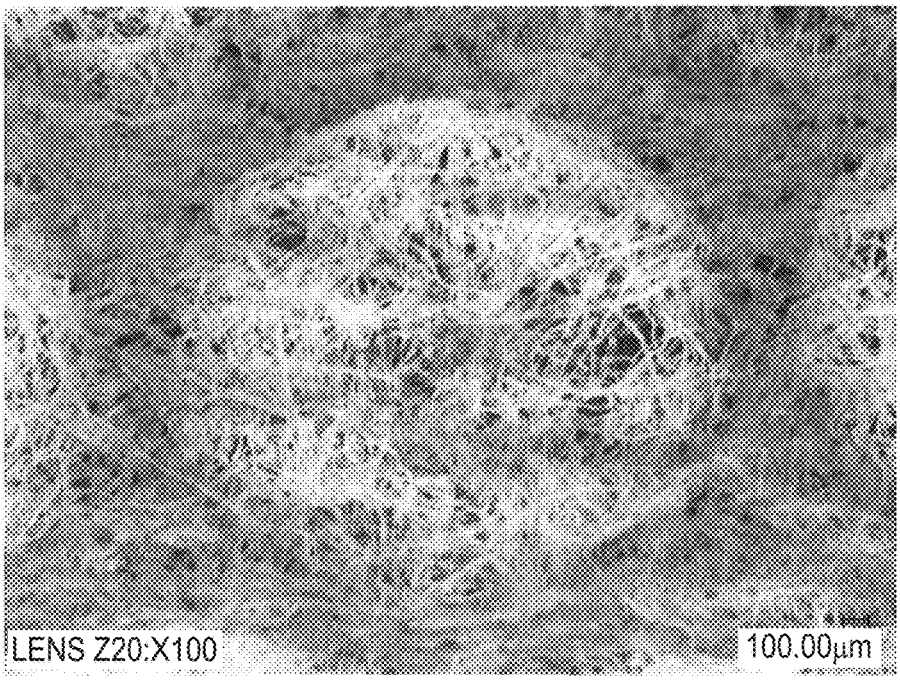
FIG. 7A(1)
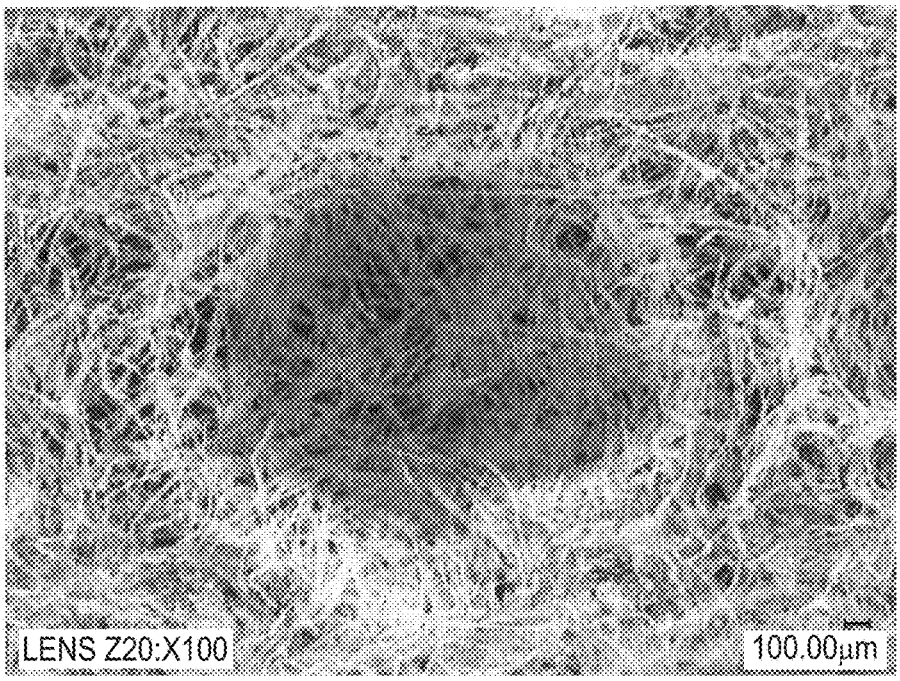
FIG. 7A(2)

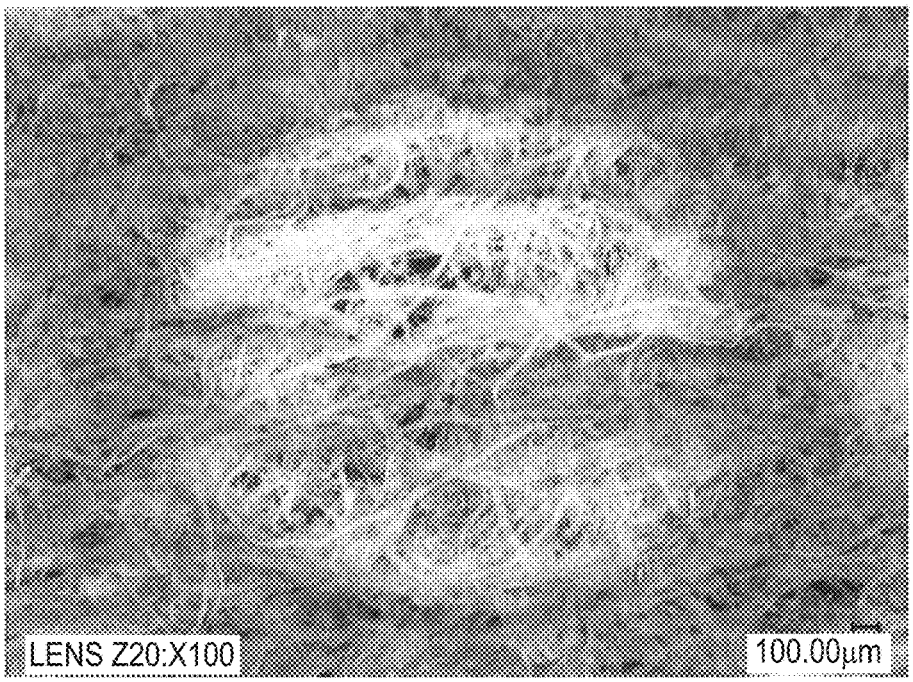
FIG. 7B(1)
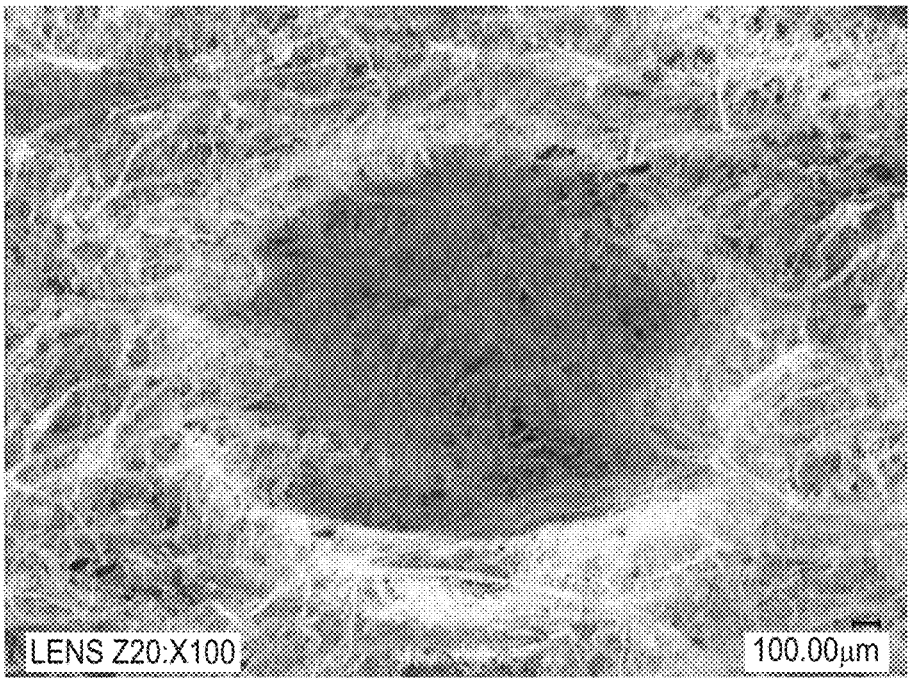
FIG. 7B(2)

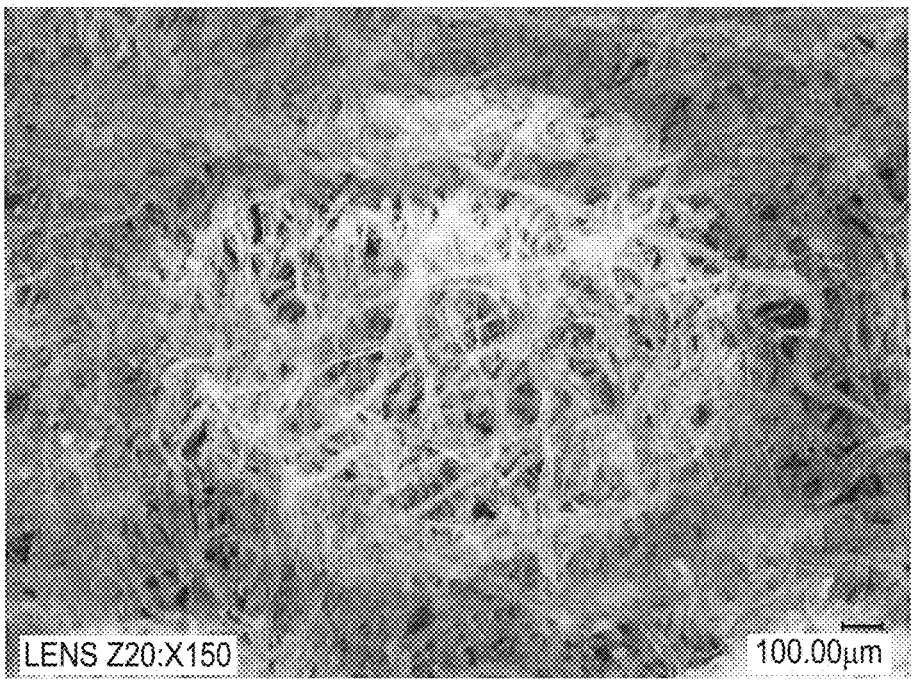
FIG. 7C(1)
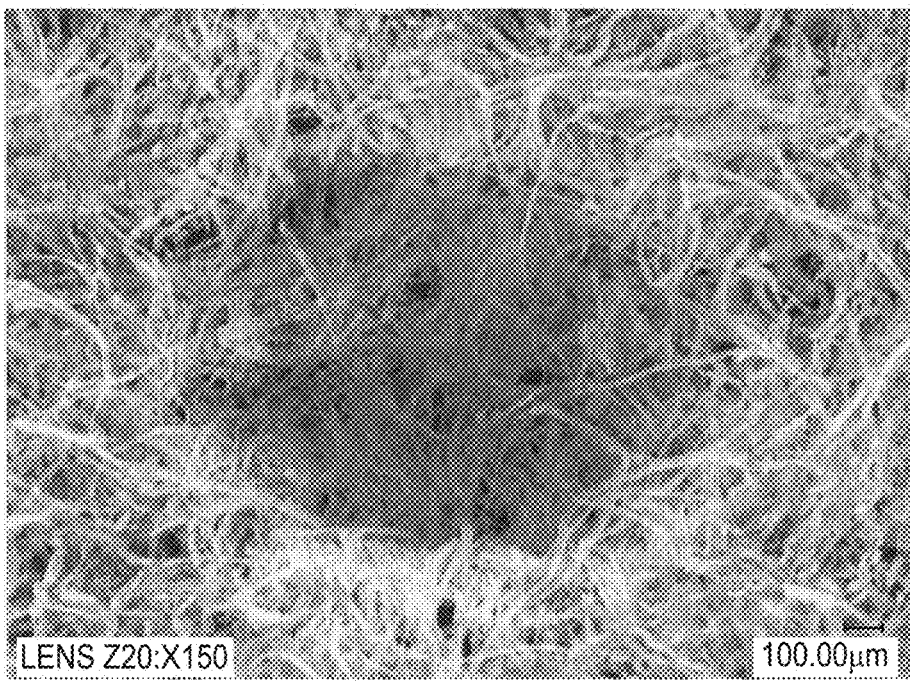
FIG. 7C(2)

METHOD OF CREPING A CELLULOSIC SHEET USING A MULTILAYER CREPING BELT HAVING OPENINGS TO MAKE PAPER PRODUCTS, AND PAPER PRODUCTS MADE USING A MULTILAYER CREPING BELT HAVING OPENINGS

This application is a divisional application of U.S. patent application Ser. No. 14/865,443, filed Sep. 25, 2015, now U.S. Pat. No. 9,863,095, which claims priority to U.S. Provisional Patent Application No. 62/055,261, filed Sep. 25, 2014, each of which is incorporated by reference herein in its entirety.

BACKGROUND

Field of the Invention

Our invention relates to a multilayer belt that can be used for creping a cellulosic web in a paper making process. Our invention also relates to methods of making paper products using a multilayer belt for creping in a papermaking process. Our invention still further relates to paper products having exceptional properties.

Related Art

Processes for making paper products, such as tissues and towels, are well known. In such processes, an aqueous nascent web is initially formed from a paper making furnish. The nascent web is dewatered using, for example, a belt-structure made from polymeric material, usually in the form of a press fabric. In some papermaking processes, after dewatering, a shape or three dimensional texture is imparted to the web, with the web thereby being referred to as a structured sheet. One manner of imparting a shape to the web involves the use of a creping operation while the web is still in a semi-solid, moldable state. A creping operation uses a creping structure such as a belt or a structuring fabric, and the creping operation occurs under pressure in a creping nip, with the web being forced into openings in the creping structure in the nip. Subsequent to the creping operation, a vacuum may also be used to further draw the web into the openings in the creping structure. After the shaping operation(s) is complete, the web is dried to substantially remove any remaining water using well-known equipment, for example, a Yankee dryer.

There are different configurations of structuring fabrics and belts known in the art. Specific examples of belts and structuring fabrics that can be used for creping in a paper making process can be seen in U.S. Pat. No. 8,152,957 and U.S. Patent Application Publication No. 2010/0186913, which are incorporated herein by reference in their entirety.

Structuring fabrics or belts have many properties that make them conducive for use in a creping operation. In particular, woven structuring fabrics made from polymeric materials, such as polyethylene terephthalate (PET), are strong, dimensionally stable, and have a three dimensional texture due to the weave pattern and the spaces between the yarns that make up the woven structure. Fabrics, therefore, can provide both a strong and flexible creping structure that can withstand the stresses and strains of operation on the papermaking machine during a papermaking process. Structuring fabrics, however, are not ideally suited for all creping operations. The openings in the structuring fabric, into which the web is drawn during shaping, are formed as spaces between the woven yarns. More specifically, the openings are formed in a three dimensional manner as there are "knuckles," or crossovers, of the woven yarns in a specific desired pattern in both the machine direction (MD) and the cross machine direction (CD). As such, there is an inherently limited variety of openings that can be constructed for a structuring fabric. Further, the very nature of a fabric being a woven structure made up of yarns effectively limits the maximum size and possible shapes of the openings that can be formed. And, still further, designing and manufacturing any fabric with specifically configured openings is an expensive and time-consuming process. Thus, while woven structuring fabrics are structurally well suited for creping in papermaking processes in terms of strength, durability, and flexibility, there are limitations on the types of shaping to the papermaking web that can be achieved when using woven structuring fabrics. As a result, it is hard to simultaneously achieve higher caliper and higher softness of a paper product made using creping operations.

As an alternative to a woven structuring fabric, an extruded polymeric belt structure can be used as the web-shaping surface in a creping operation. Unlike structuring fabrics, openings of different sizes and different shapes can be formed in polymeric structures, for example, by laser drilling or mechanical punching. The removal of material from the polymeric belt structure in forming the openings, however, has the effect of reducing the strength, durability, and resistance to MD stretch of the belt. Thus, there is a practical limit on the size and/or density of the openings that may be formed in a polymeric belt while still having the belt be viable for a papermaking process. Moreover, almost any monolithic polymeric material (i.e., a one layer extruded polymeric material) that could potentially be used to form a belt structure will be less strong and stretch resistant than a typical structuring fabric, due to the nature of a monolithic material in comparison with a woven structure.

Attempts have been made to use polymeric belt structures with an extruded polymeric layer in papermaking operations. For example, U.S. Pat. No. 4,446,187 discloses a belt structure that includes a polyurethane foil or film that is attached to at least a woven fabric for reinforcing the belt. This belt structure, however, is configured for use in dewatering operations in the forming, press, and/or drying sections of a papermaking machine. As such, this belt structure does not have openings of a sufficient size to perform web structuring, such as that in a creping operation.

An additional constraint on any creping belt or fabric to be used in a papermaking process is a requirement for the creping belt or fabric to substantially prevent cellulose fibers used to make the paper product from passing through the creping belt or fabric during the papermaking process. Fibers that pass completely through the creping belt or fabric will have a detrimental effect on the papermaking process. For example, if a substantial amount of fibers from the web is pulled completely through the creping belt or fabric when a vacuum from a vacuum box is used to draw the web into the openings of the creping structure, the fibers will eventually accumulate on the outside rim of the vacuum box. As a result, caliper of the paper product will substantially decrease due to air leaking from the seal between the vacuum box and the creping structure. Also, the accumulated fibers, which result in an unwanted variation in the paper product properties, will also have to be cleaned off of the outside rim of the vacuum box. The cleaning operation results in expensive down time for the papermaking machine and lost production. In general, it is preferable that less than one percent of the fibers should pass completely through the creping belt or fabric during a papermaking process.

SUMMARY OF THE INVENTION

According to one aspect, our invention provides a method of creping a cellulosic sheet. The method includes preparing a nascent web from an aqueous papermaking furnish, and depositing and creping the nascent web on a multilayer creping belt. The creping belt includes (i) a first layer made from a polymeric material having a plurality of openings, and (ii) a second layer attached to a surface of the first layer, with the nascent web being deposited on the first layer. A vacuum is applied to the creping belt such that the nascent web is drawn into the plurality of openings and not drawn into the second layer.

According to another aspect of our invention, a creped web is made by a process that includes steps of preparing a nascent web from an aqueous papermaking furnish, and creping the nascent web on a multilayer belt. The multilayer belt includes (i) a first layer made from a polymeric material having a plurality of openings, and (ii) a second layer attached to the first layer, with the nascent web being deposited onto a surface of the first layer. The method also includes drying and drawing the creped web without a calendering process. The nascent web is drawn into the plurality of openings in the first layer of the multilayer belt but not into the second layer, so as to provide the creped web with a plurality of dome structures.

According to a further aspect, our invention provides an absorbent sheet of cellulosic fibers that has an upper side and a lower side. The absorbent sheet includes a plurality of hollow domed regions projecting from the upper side of the sheet, with each of the hollow domed regions being shaped such that a distance from at least one first point on the edge of a hollow domed region to a second point on the edge at an opposite side of the hollow dome region is at least about 0.5 mm. The absorbent sheet also includes connecting regions forming a network interconnecting the hollow domed regions of the sheet. The absorbent sheet has a caliper of at least about 140 mils/8 sheets.

According to still a further aspect, our invention provides an absorbent sheet of cellulosic fibers that has an upper side and a lower side. The absorbent sheet includes a plurality of hollow domed regions projecting from the upper side of the sheet, with each of the hollow domed regions defining a volume of at least about 1.0 $mm^3$. The absorbent sheet also includes connecting regions forming a network interconnecting the hollow domed regions of the sheet.

According to yet another aspect, our invention provides an absorbent sheet of cellulosic fibers that has upper and lower sides. The absorbent sheet includes a plurality of hollow domed regions projecting from the upper side of the sheet, with each of the hollow domed regions defining a volume of at least about 0.5 $mm^3$. The absorbent sheet also includes connecting regions forming a network interconnecting the hollow domed regions of the sheet. The absorbent sheet has a caliper of at least about 130 mils/8 sheets.

According to a still further aspect, our invention provides an absorbent sheet of cellulosic fibers that has an upper side and a lower side. The absorbent sheet includes a plurality of hollow domed regions projecting from the upper side of the sheet, and connecting regions forming a network interconnecting the hollow domed regions of the sheet. The absorbent sheet has a caliper of at least about 145 mils/8 sheets, and the absorbent sheet has a GM tensile of less than about 3500 g/3 in.

According to yet another aspect of our invention, an absorbent sheet of cellulosic fibers is provided that has an upper side and a lower side. The absorbent sheet includes a plurality of hollow domed regions projecting from the upper side of the sheet, and connecting regions forming a network interconnecting the hollow domed regions of the sheet. A fiber density on a leading side in the machine direction (MD) of the hollow domed regions is substantially less than a fiber density on a trailing side in the MD direction of the hollow domed regions.

BRIEF DESCRIPTION OF THE DRAWINGS

FIGS. 7A(1) to 7C(2) are top and bottom views of micrographs (100×) of the dome structures in the absorbent cellulosic sheets shown in FIGS. 5A to 5C.

DETAILED DESCRIPTION OF THE INVENTION

Figure 1:
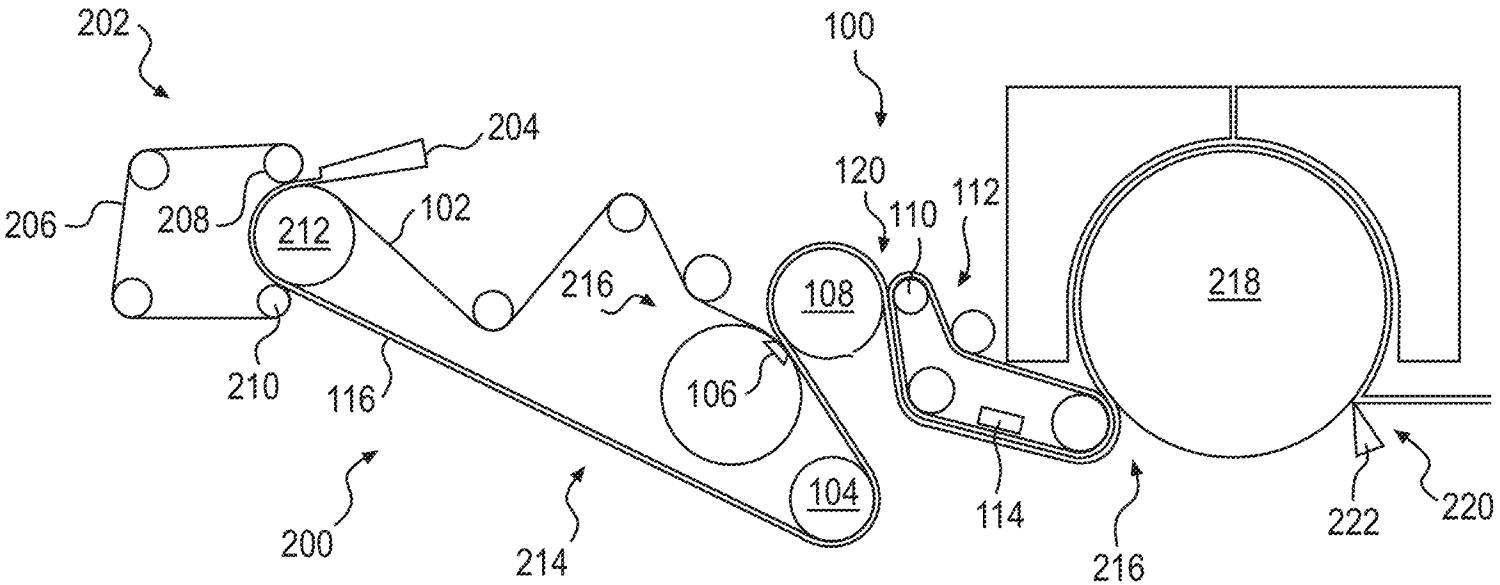
FIG. 1 is a schematic view of a paper making machine configuration that can be used in conjunction with the present invention.

In one aspect, our invention relates to papermaking processes that use a belt having a multilayer structure that can be used for creping a web as part of a papermaking process.

Our invention further relates to paper products having exceptional properties, with the paper products being capable of being formed using a multilayer creping belt.

The term "paper products" as used herein encompasses any product incorporating papermaking fiber having cellulose as a major constituent. This would include, for example, products marketed as paper towels, toilet paper, facial tissues, etc. Papermaking fibers include virgin pulps or recycle (secondary) cellulosic fibers, or fiber mixes comprising cellulosic fibers. Wood fibers include, for example, those obtained from deciduous and coniferous trees, including softwood fibers, such as northern and southern softwood kraft fibers, and hardwood fibers, such as eucalyptus, maple, birch, aspen, or the like. Examples of fibers suitable for making the webs of our invention include non-wood fibers, such as cotton fibers or cotton derivatives, abaca, kenaf, sabai grass, flax, esparto grass, straw, jute hemp, bagasse, milkweed floss fibers, and pineapple leaf fibers. "Furnishes" and like terminology refers to aqueous compositions including papermaking fibers, and, optionally, wet strength resins, debonders, and the like, for making paper products.

As used herein, the initial fiber and liquid mixture that is dried to a finished product in a papermaking process will be referred to as a "web" and/or a "nascent web." The dried, single-ply product from a papermaking process will be referred to as a "basesheet." Further, the product of a papermaking process may be referred to as an "absorbent sheet." In this regard, an absorbent sheet may be the same as a single basesheet. Alternatively, an absorbent sheet may include a plurality of basesheets, as in a multi-ply structure. Further, an absorbent sheet may have undergone additional processing after being dried in the initial basesheet forming process, e.g., embossing.

When describing our invention herein, the terms "machine-direction" (MD) and "cross machine-direction" (CD) will be used in accordance with their well-understood meaning in the art. That is, the MD of a belt or other creping structure refers to the direction that the belt or other creping structure moves in a papermaking process, while CD refers to a direction crossing the MD of the belt or creping structure. Similarly, when referencing paper products, the MD of the paper product refers to the direction on the product that the product moved in the papermaking process, and the CD refers to the direction on the paper product crossing the MD of the product.

Papermaking Machines

Processes utilizing the inventive belts and making the inventive products may involve compactly dewatering papermaking furnishes having a random distribution of fibers so as to form a semi-solid web, and then belt creping the web so as to redistribute the fibers and shape the web in order to achieve paper products with desired properties. These steps of papermaking processes can be conducted on papermaking machines having many different configurations. Two examples of such papermaking machines will now be described.

FIG. 1 shows a first example of a papermaking machine 200. The papermaking machine 200 is a three-fabric loop machine that includes a press section 100 in which a creping operation is conducted. Upstream of the press section 100 is a forming section 202, which, in the case of papermaking machine 200, is referred to in the art as a crescent former. The forming section 202 includes headbox 204 that deposits a furnish on a forming wire 206 supported by rolls 208 and 210, thereby initially forming the papermaking web. The forming section 202 also includes a forming roll 212 that supports a papermaking felt 102 such that web 116 is also formed directly on the papermaking felt 102. The felt run 214 extends to a shoe press section 216 wherein the moist web is deposited on a backing roll 108, with the web 116 being wet-pressed concurrently with the transfer to the backing roll 108.

An example of an alternative to the configuration of papermaking machine 200 includes a twin-wire forming section, instead of the crescent forming section 202. In such a configuration, downstream of the twin-wire forming section, the rest of the components of such a papermaking machine may be configured and arranged in a similar manner to that of papermaking machine 200. An example of a papermaking machine with a twin-wire forming section can be seen in the aforementioned U.S. Patent Application Pub. No. 2010/0186913, which matured into U.S. Pat. No. 8,293,072. Still further examples of alternative forming sections that can be used in a paper making machine include a C-wrap twin wire former, an S-wrap twin wire former, or a suction breast roll former. Those skilled in the art will recognize how these, or even still further alternative forming sections, can be integrated into a papermaking machine.

The web 116 is transferred onto the creping belt 112 in a belt crepe nip 120, and then vacuum drawn by vacuum box 114, as will be described in more detail below. After this creping operation, the web 116 is deposited on Yankee dryer 218 in another press nip 216 using a creping adhesive. The transfer to the Yankee dryer 218 may occur, for example, with about 4% to about 40% pressurized contact area between the web 116 and the Yankee surface at a pressure of about 250 pounds per linear inch (PLI) to about 350 PLI (about 43.8 kN/meter to about 61.3 kN/meter). The transfer at nip 216 may occur at a web consistency, for example, from about 25% to about 70%. Note that "consistency," as used herein, refers to the percentage of solids of a nascent web, for example, calculated on a bone dry basis. At about 25% to about 70% consistency, it is sometimes difficult to adhere the web 116 to the surface of the Yankee dryer 218 firmly enough so as to thoroughly remove the web from the creping belt 112. In order to increase the adhesion between the web 116 and the surface of the Yankee dryer 218, an adhesive may be applied to the surface of the Yankee dryer 218. The adhesive can allow for high velocity operation of the system and high jet velocity impingement air drying, and also allow for subsequent peeling of the web 116 from the Yankee dryer 218. An example of such an adhesive is a poly(vinyl alcohol)/polyamide adhesive composition, with an example application rate of this adhesive being at a rate of less than about 40 $mg/m^2$ of sheet. Those skilled in the art, however, will recognize the wide variety of alternative adhesives, and further, quantities of adhesives, that may be used to facilitate the transfer of the web 116 to the Yankee dryer 218.

The web 116 is dried on Yankee dryer 218, which is a heated cylinder and by high jet velocity impingement air in the Yankee hood around the Yankee dryer 218. As the Yankee dryer 218 rotates, the web 116 is peeled from the dryer 218 at position 220. The web 116 may then be subsequently wound on a take-up reel (not shown). The reel may be operated faster than the Yankee dryer 218 at steady-state in order to impart a further crepe to the web 116. Optionally, a creping doctor blade 222 may be used to conventionally dry-crepe the web 116. In any event, a cleaning doctor may be mounted for intermittent engagement and used to control build up.

Figure 2:
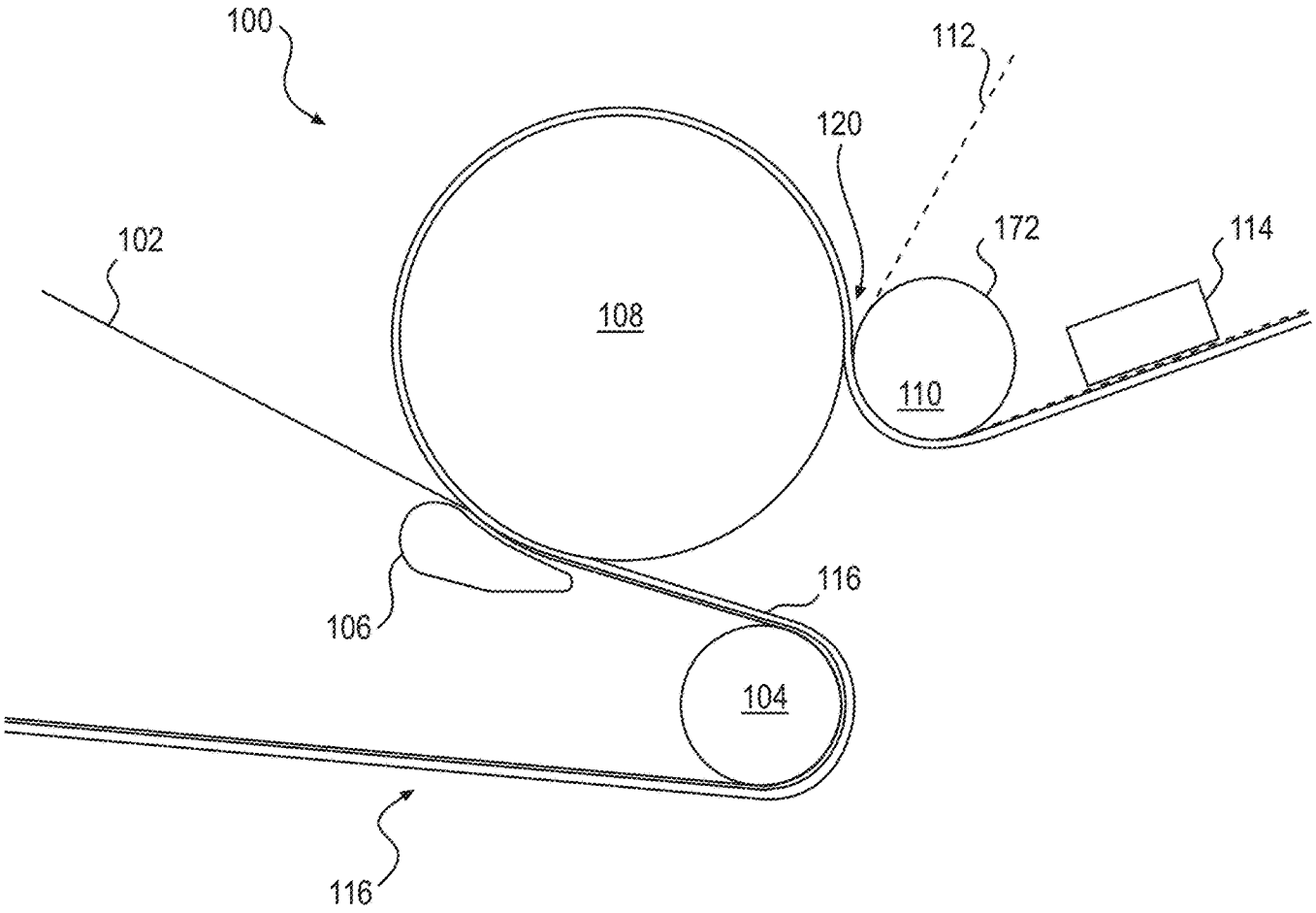
FIG. 2 is a schematic view illustrating the wet-press transfer and belt creping section of the papermaking machine shown in FIG. 1.

FIG. 2 shows details of the press section 100 where creping occurs. The press section 100 includes a papermaking felt 102, a suction roll 104, a press shoe 106, and a backing roll 108. The backing roll 108 may optionally be heated, for example, by steam. The press section 100 also includes a creping roll 110, the creping belt 112, and the vacuum box 114. The creping belt 112 may be configured as the inventive multilayer belt that will described in detail below.

In a creping nip 120, the web 116 is transferred onto the top side of the creping belt 112. The creping nip 120 is defined between the backing roll 108 and the creping belt 112, with the creping belt 112 being pressed against the backing roll 108 by the surface 172 of the creping roll 110. In this transfer at the creping nip 120, the cellulosic fibers of the web 116 are repositioned and oriented, as will be described in detail below. After the web 116 is transferred onto the creping belt 112, a vacuum box 114 may be used to apply suction to the web 116 in order to at least partially draw out minute folds. The applied suction may also aid in drawing the web 116 into openings in the creping belt 112, thereby further shaping the web 116. Further details of this shaping of the web 116 will be described below.

The creping nip 120 generally extends over a belt creping nip distance or width of anywhere from, for example, about ⅛ in. to about 2 in. (about 3.18 mm to about 50.8 mm), more specifically, about 0.5 in. to about 2 in. (about 12.7 mm to about 50.8 mm). The nip pressure in creping nip 120 arises from the loading between creping roll 110 and backing roll 108. The creping pressure is, generally, from about 20 to about 100 PLI (about 3.5 kN/meter to about 17.5 kN/meter), more specifically, about 40 PLI to about 70 PLI (about 7 kN/meter to about 12.25 kN/meter). While a minimum pressure in the creping nip 120 of 10 PLI (1.75 kN/meter) or 20 PLI (3.5 kN/meter) is often necessary, one of skill in the art will appreciate that, in a commercial machine, the maximum pressure may be as high as possible, limited only by the particular machinery employed. Thus, pressures in excess of 100 PLI (17.5 kN/meter), 500 PLI (87.5 kN/meter), or 1000 PLI (175 kN/meter) or more may be used, if practical, and provided a velocity delta can be maintained.

In some embodiments, it may by desirable to restructure the interfiber characteristics of the web 116, while, in other cases, it may be desired to influence properties only in the plane of the web 116. The creping nip parameters can influence the distribution of fibers in the web 116 in a variety of directions, including inducing changes in the z-direction (i.e., the bulk of the web 116), as well as in the MD and CD. In any case, the transfer from the creping belt 112 is at high impact in that the creping belt 112 is traveling slower than the web 116 is traveling off of the backing roll 108, and a significant velocity change occurs. In this regard, the degree of creping is often referred to as the creping ratio, with the ratio being calculated as:

$$\text{Creping Ratio } (\%) = S_1/S_2 - 1$$

where $S_1$ is the speed of the backing roll 108 and $S_2$ is the speed of the creping belt 112. Typically, the web 116 is creped at a ratio of about 5% to about 60%. In fact, high degrees of crepe can be employed, approaching or even exceeding 100%.

It should once again be noted that the papermaking machine depicted in FIG. 1 is merely an example of the possible configurations that can be used with the invention described herein. Further examples include those described in the aforementioned U.S. Patent Application Pub. No. 2010/0186913.

Multilayer Creping Belts

Our invention is directed, in part, to a multilayer belt that can be used for the creping operations in papermaking machines such as those described above. As will be evident from the disclosure herein, the structure of the multilayer belt provides many advantageous characteristics that are particularly suited for creping operations. It should be noted, however, that inasmuch as the belt is structurally described herein, the belt structure could be used for applications other than creping operations, such as strictly a molding process that provides shapes to a papermaking web.

A creping belt must have diverse properties in order to perform satisfactorily in papermaking machines, such as those described above. On one hand, it is important for the creping belt to be able to withstand the tension, compression, and friction that are applied to the creping belt during operation. As such, the creping belt must be strong, or, more specifically, have a high elastic modulus (dimensional stability), especially in the MD. On the other hand, the creping belt must be flexible and durable in order to run smoothly (e.g., flat) at a high speed for extended periods of time. If the creping belt is made too brittle, it will be susceptible to cracking or other fracturing during operation. The combination of being strong, yet flexible, restricts the potential materials that can be used to form a creping belt. That is, the creping belt structure must have the ability to achieve the combination of strength and flexibility.

In addition to being both strong and flexible, a creping belt should ideally allow for the formation of diverse opening sizes and shapes on the paper-forming surface of the belt. The openings in the creping belt form the caliper-producing domes in the final paper structure, as will described in detail below. More specifically, and without being bound by any particular theory, it is believed that the caliper of products generated using a creping belt is directly proportional to the size of the openings in the belt. Larger openings in the creping belt allow for greater amounts of fibers to be formed into dome structures that are ultimately found in the finished product, and the dome structures provide additional caliper in the product. Examples demonstrating the caliper that can be generated using the present invention will be described below. Openings in the creping belt also can be used to impart specific shapes and patterns on the web being creped, and thus, the paper products that are formed. By using different sizes, densities, distribution, and depth of the openings, the top layer of the belt can be used to generate paper products having different visual patterns, bulk, and other physical properties. In sum, an important feature of any potential material or combination of materials for use in forming a creping belt is the ability to form diverse openings in the surface of the material to be used for supporting the web in the creping operation.

Extruded polymeric materials can be formed into creping belts having diverse openings, and hence, extruded polymeric materials are possible materials for use in forming a creping belt. In particular, precisely shaped openings can be formed in an extruded polymeric belt structure by different techniques, including, for example, laser drilling or cutting. All other considerations being equal, a primary limiting factor of the types and sizes of openings that can be formed in a given monolithic polymeric belt is that the total amount of belt material that can be removed to form the openings is limited. If too much of the belt material is removed to form the openings, the structure of a monolithic polymeric belt would be insufficient to withstand the strain of a creping operation in a papermaking process. That is, a polymeric belt having been provided with too large of openings will break early in its use in a papermaking process.

The creping belt according to our invention provides all of the desirable aspects of a polymeric creping belt by providing different properties to the belt in different layers of the overall belt structure. Specifically, the multilayer belt includes a top layer made from a polymeric material that allows for openings with diverse shapes and sizes to be formed in the layer. Meanwhile, the bottom layer of the multilayer belt is formed from a material that provides strength and durability to the belt. By providing the strength and durability in the bottom layer, the top polymeric layer can be provided with larger openings than could otherwise be provided in a polymeric belt because the top layer need not contribute to the strength and durability of the belt.

A multilayer creping belt according to the invention includes at least two layers. As used herein, a "layer" is a continuous, distinct part of the belt structure that is physically separated from another continuous, distinct layer in the belt structure. As will be discussed below, an example of two layers in a multilayer belt according to the invention is a polymeric layer that is bonded with an adhesive to the fabric layer. Notably, a layer, as defined herein, could include a structure having another structure substantially embedded therein. For example, U.S. Pat. No. 7,118,647 describes a papermaking belt structure wherein a layer that is made from photosensitive resin has a reinforcing element embedded in the resin. This photosensitive resin with a reinforcing element is a layer in the terms of the present invention. At the same time, however, the photosensitive resin with the reinforcing element does not constitute a "multilayer" structure as used in the present application, as the photosensitive resin with the reinforcing element are not two continuous, distinct parts of the belt structure that are physically separated from each other.

Details of the top and bottom layers for a multilayer belt according to the invention are described next. Herein, the "top" or "sheet" or "Yankee" side of the creping belt refers to the side of the belt on which the web is deposited for the creping operation. Hence, the "top layer" is the portion of the multilayer belt that forms the surface onto which the cellulosic web is shaped in the creping operation. The "bottom" or "air" ("machine") side of the creping belt, as used herein, refers to the opposite side of the belt, i.e., the side that faces and contacts the processing equipment such as the creping roll and the vacuum box. And, accordingly, the "bottom layer" provides the bottom (air) side surface.

Top Layer

One of the functions of the top layer of a multilayer belt according to the invention is to provide a structure into which openings can be formed, with the openings passing through the layer from one side of the layer to the other, and with the openings imparting dome shapes to the web in a papermaking process. The top layer does not need to impart any strength and durability to the belt structure, per se, as these properties will be provided primarily by the bottom layer, as described below. Further, the openings in the top layer need not be configured to prevent fibers from being pulled through the top layer in the papermaking process, as this will also be achieved by the bottom layer, as will also be described below.

In some embodiments of the invention, the top layer of our multilayer belt is made from an extruded flexible thermoplastic material. In this regard, there is no particular limitation on the types of thermoplastic materials that can be used to form the top layer, as long as the material generally imparts the properties such as friction (e.g., between the paper forming web and the belt), compressibility, and tensile strength for the top layer described herein. And, as will be apparent to those skilled in the art from the disclosure herein, there are numerous possible flexible thermoplastic materials that can be used that will provide substantially similar properties to the thermoplastics specifically discussed herein. It should also be noted that the term "thermoplastic material" as used herein is intended to include thermoplastic elastomers, e.g., rubber materials. It should be further noted that the thermoplastic material could include either thermoplastic materials in fiber form (e.g., chopped polyester fiber) or non-plastic additives, such as those found in composite materials.

A thermoplastic top layer can be made by any suitable technique, for example, molding, extruding, thermoforming, etc. Notably, the thermoplastic top layer can be made from a plurality of sections that are joined together, for example, side to side in a spiral fashion as described in U.S. Pat. No. 8,394,239, the disclosure of which is incorporated by reference in its entirety. Moreover, the thermoplastic top layer can be made to any particular required length, and can be tailored to the path length required for any specific papermaking machine configuration.

In specific embodiments, the material used to form the top layer of the multilayer belt is polyurethane. In general, thermoplastic polyurethanes are manufactured by reacting (1) diisocyanates with short-chain diols (i.e., chain extenders) and (2) diisocyanates with long-chain bifunctional diols (i.e., polyols). The practically unlimited number of possible combinations producible by varying the structure and/or molecular weight of the reaction compounds allows for an enormous variety of polyurethane formulations. And, it follows that polyurethanes are thermoplastic materials that can be made with an extraordinary wide range of properties. When considering polyurethanes for use as the top layer in a multilayer creping belt according to the invention, it is highly advantageous to be able to adjust the hardness of the polyurethane, and correspondingly, the coefficient of friction of the surface of the polyurethane. TABLE 1 shows the properties of an example of polyurethane that is used to form the top layer of the multilayer belt in some embodiments of the invention.

TABLE 1

| Property | Standard | Value |
|---|---|---|
| Tensile Strength (lb/in$^2$) | ASTM D412 | 5500-7500 |
| Tear Strength, Die C (lbf/in) | ASTM D624 | 250-750 |
| Durometer, Shore ±5 | ASTM D2240 | 75A to 75D |

Polyurethanes having properties in the ranges shown in TABLE 1 will be effective when used as the top layer in a multilayer belt as described herein. As will be appreciated by those skilled in the art, the values of the properties shown in Table 1 are approximate, and therefore may be somewhat varied outside the indicated ranges while still providing a multilayer belt with the properties described herein. Examples of specific polyurethanes with these properties are sold under the designations MP750, MP850, MP950, and MP160 by San Diego Plastics, Inc. of National City, Calif.

As an alternative to polyurethane, an example of a specific thermoplastic that may be used to form the top layer in other embodiments of the invention is sold under the name HYTREL® by E. I. du Pont de Nemours and Company of Wilmington, Del. HYTREL® is a polyester thermoplastic elastomer with the friction, compressibility, and tensile properties conducive to forming the top layer of the multilayer creping belt described herein.

Thermoplastics, such as the polyurethanes described above, are advantageous materials for forming the top layer of the inventive multilayer belt when considering the ability to form openings of different sizes and configurations in thermoplastics. Openings in the thermoplastic used to form the top layer may be easily formed using a variety of techniques. Examples of such techniques include laser engraving, drilling, cutting or mechanical punching. As will be appreciated by those skilled in the art, such techniques can be used to form large and consistently-sized openings. In fact, openings of most any configuration (dimensions, shape, sidewall angle, etc.) can be formed in a thermoplastic top layer using such techniques.

When considering the different configurations of the openings that can be formed in the top layer, it is important to note that the openings need not be identical. That is, some of the openings formed in the top layer can have different configurations from other openings that are formed in the top layer. In fact, different openings could be provided in the top layer in order to provide different functions in the paper making process. For example, some of the openings in the top layer could be sized and shaped to provide for forming dome structures in the papermaking web during the creping operation (described in detail below). At the same time, other openings in the top layer could be of a much greater size and a varying shape so as to provide patterns in the papermaking web that are equivalent to patterns that are achieved with an embossing operation. However, the patterns are achieved without the undesirable effects of embossing, such as loss in sheet bulk and other desired properties.

When considering the size of the openings for forming dome structures in the papermaking web in a creping operation, the top layer of the inventive multilayer belt allows for much larger sizes than alternative structures, such as woven structuring fabrics and monolithic polymeric belt structures. The size of the openings may be quantified in terms of the cross-sectional area of the openings in the plane of the surface of the multilayer belt provided by the top layer. In some embodiments, the openings in the top layer of a multilayer belt have an average cross-sectional area on the forming (top) surface of at least about 1.0 $mm^2$. More specifically, the openings have an average cross-sectional area from about 1.0 $mm^2$ to about 15 $mm^2$, or still more specifically, about 1.5 $mm^2$ to about 8.0 $mm^2$, or even more specifically, about 2.1 $mm^2$ to about 7.1 $mm^2$. As will be readily appreciated by those skilled in the art, it would be extremely difficult, if not impossible or impractical, to form a monolithic belt having openings with the cross-sectional areas of the multilayer belt according to the invention. For example, openings of these sizes would require the removal of the bulk of the material forming the monolithic belt such that the belt would likely not be durable enough to withstand the rigors and stresses of a papermaking belt creping process. As will also be readily appreciated by those skilled in the art, a woven structuring fabric could likely not be provided with the equivalent to these size openings, as the yarns of the fabric could not be woven (spaced apart or size) to provide such an equivalent to the openings, and yet still provide enough structural integrity to be able to function in a papermaking process.

The size of the openings may also be quantified in terms of volume. Herein, the volume of an opening refers to the space that the opening occupies through the thickness of the belt. The openings in the top layer of a multilayer belt according to the invention may have a volume of at least about 0.2 $mm^3$. More specifically, the volume of the openings may range from about 0.5 $mm^3$ to about 23 $mm^3$, or more specifically, the volume of the openings ranges from 0.5 $mm^3$ to about 11 $mm^3$. As will be appreciated by those skilled in the art, it would be extremely difficult, if not impossible or impractical, to produce a viable monolithic thermoplastic belt having a substantial number of openings having such volumes due to the amount of belt material (mass) that would be removed in forming the openings. That is, as mentioned above, a monolithic belt having a substantial number of openings having the volumes described herein would not be durable enough to withstand the stresses that are a part of a papermaking process. As will also be appreciated by those skilled in the art, in comparison to the clearly defined openings in the creping belts described herein, in structuring fabrics, the volume of "openings" is not clearly defined through the structuring fabric due to the nature of the woven structure. In any event, a woven structuring fabric cannot provide the equivalent to the volume of openings in the multilayer belt according to the invention.

Other unique characteristics of the multilayer belt according to the invention include the percentage of contact area provided by the top surface of the belt that is provided by the top layer. The percentage contact area of the top surface refers to the percentage of the surface of the belt that is not an opening. The percentage contact layer is related to the fact that larger openings can be formed in the inventive multilayer belt than in woven structuring fabrics or monolithic belts. That is, openings, in effect, reduce the contact area of the top surface of the belt, and as the multilayer belt can have larger openings, the percentage contact area is reduced. In embodiments of the invention, the top surface of the multilayer belt provides about 10% to about 65% contact area. In more specific embodiments, the top surface provides about 15% to about 50% contact area, and, in still more specific embodiments, the top surface provides about 20% to about 33% contact area. Once again, those skilled in the art will recognize that the upper end of these ranges of contact areas could not likely be found in a woven structuring fabric or a monolithic belt for commercial papermaking operations.

Opening density is yet another measure of the relative size and number of openings in the top surface provided by the top layer of the inventive multilayer belt. Here, opening density of the top surface refers to the number of openings per unit area, e.g., the number of openings per $cm^2$. In embodiments of the invention, the top surface provided by the top layer has an opening density of about $10/cm^2$ to about $80/cm^2$. In more specific embodiments, the top surface provided by the top layer has an opening density of about $20/cm^2$ to about $60/cm^2$, and, in still more specific embodiments, the top surface has an opening density of about $25/cm^2$ to about $35/cm^2$. As described herein, the openings of the belt form dome structures in the web during a creping operation. The inventive multilayer belt can provide higher opening densities than can be formed in a monolithic belt, and higher opening densities than could equivalently be achieved with a woven structuring fabric. Thus, the multilayer belt can be used to form more dome structures in a web during a creping operation than a monolithic belt or a woven structuring fabric, and accordingly, the multilayer belt can be used in a papermaking process that produces paper products having a greater number of dome structures than could structuring fabrics or monolithic belts.

Two other aspects of the creping surface formed by the top layer of the multilayer belt that affect the papermaking process are the friction and hardness of the top surface. Without being bound by theory, it is believed that a softer creping structure (belt or fabric) will provide better pressure uniformity inside of a creping nip. Further, the friction on the surface of the creping belt minimizes slippage of the web during the transfer of the web to the creping belt in the creping nip. Less slippage of the web causes less wear on the creping belt, and allows for the creping structure to work well for both the upper and lower basis weight ranges. It should also be noted that a creping belt can prevent web slippage without substantially damaging the web. In this regard the creping belt is advantageous over a woven fabric structure because knuckles on the surface of the woven fabric may act to disrupt the web during the creping operation. Thus, a multilayer belt structure may provide a better result in the low basis weight range where web disruptions can be detrimental in the creping process. This ability to work in a low basis weight range may be advantageous, for example, when forming facial tissue products.

When considering the material for use in forming the top layer of the inventive multilayer belt, polyurethane is a well-suited material, as discussed above. Polyurethane is a relatively soft material for use in a creping belt, especially, when compared to materials that could be used to form a monolithic creping belt. At the same time, polyurethane can provide a relatively-high friction surface. Polyurethane is known to have a coefficient of friction ranging from about 0.5 to about 2 depending on its formulation. In example embodiments of our invention, the polyurethane top surface of the multilayer belt has a coefficient of friction of about 0.6. Notably, the HYTREL® thermoplastic, also discussed above as being a well-suited material for forming the top layer, has a coefficient of friction of about 0.5. Thus, the inventive multilayer belt can provide a soft and high-friction top surface, effecting a "soft" sheet creping operation.

The friction of the top surface of the top layer, as well as other surface phenomena of the top surface, can be changed through the application of coatings on the top surface. In this regard, a coating can be added to the top surface to increase or to decrease the friction of the top surface. Additionally, or alternatively, a coating can be added to the top surface to change the release properties of the top surface. Examples of such coatings include both hydrophobic and hydrophilic compositions, depending on the specific papermaking processes in which the multilayer creping belt is to be used. These coatings can be sprayed onto the belt during a papermaking process, or the coatings can be formed as a permanent coating attached to the top surface of the multilayer belt.

Bottom Layer

The bottom layer of the multilayer creping belt functions to provide strength, MD stretch and creep resistance, CD stability, and durability to the belt. As discussed above, a flexible polymeric material, such as polyurethane, provides an attractive option for the top layer of the belt. Polyurethane, however, is a relatively weak material that, by itself, will not provide the desirable properties to the belt. A homogenous monolithic polyurethane belt would not be able to withstand the stresses and strains imparted to the belt during a papermaking process. By joining a polyurethane top layer with a second layer, however, the second layer can provide the required strength, stretch resistance, etc., to the belt. In essence, the use of a distinct bottom layer, separate from the top layer, expands the potential range of materials that can be used for the top layer.

As with the top layer, the bottom layer also includes a plurality of openings through the thickness of the layer. Each opening in the bottom layer is aligned with at least one opening in the top layer, and thus, openings are provided through the thickness of the multilayer belt, i.e., through the top and bottom layers. The openings in the bottom layer, however, are smaller than the openings in the top layer. That is, the openings in the bottom layer have a smaller cross-sectional area adjacent to the interface between the top layer and the bottom layer than the cross-sectional area of the plurality of openings of the top layer adjacent to the interface between the top and bottom layers. The openings in the bottom layer, therefore, can prevent cellulosic fibers from being pulled completely through the multilayer belt structure, for example, when the belt and papermaking web are exposed to a vacuum. As generally discussed above, fibers that are pulled through the belt are detrimental to a papermaking process in that the fibers build up in the papermaking machine over time, e.g., accumulating on the outside rim of the vacuum box. The buildup of fibers necessitates machine down time in order to clean out the fiber buildup. The openings in the bottom layer, therefore, can be configured to substantially prevent fibers from being pulled through the belt. However, because the bottom layer does not provide the creping surface, and thus, does not act to shape the web during the creping operation, configuring the openings in the bottom layer to prevent fiber pull through does not substantially affect the creping operation of the belt.

In some embodiments of the invention, a woven fabric is provided as the bottom layer of the multilayer creping belt. As discussed above, woven structuring fabrics have the strength and durability to withstand the forces of a creping operation. And, as such, woven structuring fabrics have been used, by themselves, as creping structures in papermaking processes. A woven structuring fabric, therefore, can provide the necessary strength, durability, and other properties for the multilayer creping belt according to the invention.

In specific embodiments of the multilayer creping belt, the woven fabric provided for the bottom layer has similar characteristics to woven structuring fabrics used by themselves as creping structures. Such fabrics have a woven structure that, in effect, has a plurality of "openings" formed between the yarns making up the fabric structure. In this regard, the result of the openings in a fabric may be quantified as an air permeability that allows airflow through the fabric. In terms of our invention, the permeability of the fabric, in conjunction with the openings in the top layer, allows air to be drawn through the belt. Such airflow can be drawn through the belt at a vacuum box in the papermaking machine, as described above. Another aspect of the woven fabric layer is the ability to prevent fibers from being pulled completely through the multilayer belt at the vacuum box. In general, it is preferable that less than one percent of the fibers should pass completely through the creping belt or fabric during a papermaking process.

The permeability of a fabric is measured according to well-known equipment and tests in the art, such as Frazier® Differential Pressure Air Permeability Measuring Instruments by Frazier Precision Instrument Company of Hagerstown, Md. In embodiments of the multilayer belt according to the invention, the permeability of the fabric bottom layer is at least about 350 CFM. In more specific embodiments, the permeability of the fabric bottom layer is about 350 CFM to about 1200 CFM, and in even more specific embodiments, the permeability of the fabric bottom layer is between about 400 to about 900 CFM. In still further embodiments, the permeability of the fabric bottom layer is about 500 to about 600 CFM.

TABLE 2 shows specific examples of structuring fabrics that can be used to form the bottom layer in the multilayer creping belts according to the invention. All of the fabrics identified in TABLE 2 are manufactured by Albany International Corporation of Rochester, N.H.

TABLE 2

| Name | Mesh (cm) | Count (cm) | Warp Size (mm) | Shute Size (mm) | Perm. (CFM) |
|---|---|---|---|---|---|
| ElectroTech 55LD | 22 | 19 | 0.25 | 0.4 | 1000 |
| U5076 | 15.5 | 17.5 | 0.35 | 0.35 | 640 |
| J5076 | 33 | 34 | 0.17 | 0.2 | 625 |
| FormTech 55LD | 21 | 19 | 0.25 | 0.35 | 1200 |
| FormTech 598 | 22 | 15 | 0.25 | 0.35 | 706 |
| FormTech 36BG | 15 | 16 | 0.40 | 0.40 | 558 |

Specific examples of multilayer belts with J5076 fabric as the bottom layer are exemplified below. J5076 is made from polyethylene terephthalate (PET).

As an alternative to a woven fabric, in other embodiments of the invention, the bottom layer of the multilayer creping belt can be formed from an extruded thermoplastic material. Unlike the flexible thermoplastic materials used to form the top layer discussed above, however, the thermoplastic material used to form the bottom layer is provided in order to impart strength, stretch resistance, durability, etc., to the multilayer creping belt. Examples of thermoplastic materials that can be used to form the bottom layer include polyesters, copolyesters, polyamides, and copolyamides. Specific examples of polyesters, copolyesters, polyamides, and copolyamides that can be used to form the bottom layer can be found in the aforementioned U.S. Patent Application Pub. No. 2010/0186913, which matured into U.S. Pat. No. 8,293,072.

In specific embodiments of the invention, PET may be used to form the extruded bottom layer of the multilayer belt. PET is a well-known durable and flexible polyester. In other embodiments, HYTREL® (which is discussed above) may be used to form the extruded bottom layer of the multilayer belt. Those skilled in the art will recognize similar alternative materials that could be used to form the bottom layer.

When using an extruded polymeric material for the bottom layer, openings may be provided through the polymeric material in the same manner as the openings are provided in the top layer, e.g., by laser drilling, cutting, or mechanical perforation. At least some of the openings in the bottom layer are aligned with the openings in the top layer, thereby allowing for air flow through the multilayer belt structure in the same manner that a woven fabric bottom layer allows for air flow through the multilayer belt structure. The openings in the bottom layer need not, however, be the same size as the openings in the top layer. In fact, in order to reduce fiber pull-through in a manner analogous to a fabric bottom layer, the openings in the extruded polymeric bottom layer may be substantially smaller than the openings in the top layer. In general, the size of the openings in the bottom layer can be adjusted to allow for certain amounts of air flow through the belt. Moreover, multiple openings in the bottom layer may be aligned with an opening in the top layer. A greater air flow can be drawn through the belt at a vacuum box if multiple openings are provided in the bottom layer, so as to provide a greater total opening area in the bottom layer relative to the opening area in the top layer. At the same time, the use of multiple openings with a smaller cross-sectional area reduces the amount of fiber pull-through relative to a single, larger, opening in the bottom layer. In a specific embodiment of the invention, the openings in the second layer have a maximum cross-sectional area of 350 square microns adjacent to the interface with the first layer.

Along these lines, in embodiments of the invention with an extruded polymeric top layer and an extruded polymeric bottom layer, a characteristic of the belt is the ratio of the cross-sectional area of the openings at the top surface provided by the top layer to the cross-sectional area of the openings in the bottom surface provided by the bottom layer. In embodiments of the invention, this ratio of cross-sectional areas of the top and bottom openings ranges from about 1 to about 48. In more specific embodiments, the ratio ranges from about 4 to about 8. In an even more specific embodiment, the ratio is about 5.

There are other materials that may be used to form the bottom layer in alternatives to the woven fabric and extruded polymeric layer described above. For example, in an embodiment of the invention, the bottom layer may be formed from metallic materials, and in particular, a metallic screen-like structure. The metallic screen provides the strength and flexibility properties to the multilayer belt in the same manner as the woven fabric and extruded polymeric layer described above. Further, the metallic screen functions to prevent cellulose fibers from being pulled through the belt structure, in the same manner as the woven fabric and extruded polymeric materials described above. A still further alternative material that could be used to form the bottom layer is a super-strong fiber material, such as a material formed from para-aramid synthetic fibers. Super-strong fibers may differ from the fabrics described above by not being woven together, but yet still be capable of forming a strong and flexible bottom layer. Those skilled in the art will recognize still further alternative materials that are capable of providing the properties of the bottom layer of the multilayer belt described herein.

Multilayer Structure

The multilayer belt according to the invention is formed by connecting the above-described top and bottom layers. As will be understood from the disclosure herein, the connection between the layers can be achieved using a variety of different techniques, some of which will be described more fully below.

Figure 3A:
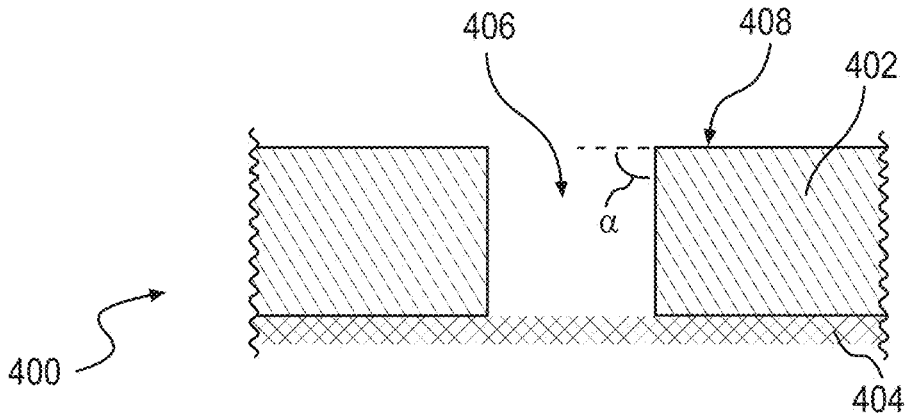
FIG. 3A is a cross-sectional view of a portion of a multilayer creping belt according to an embodiment of the invention.

FIG. 3A is a cross-sectional view of a portion of a multilayer creping belt 400 according to an embodiment of the invention. The belt 400 includes a polymeric top layer 402 and a fabric bottom layer 404. The polymeric top layer 402 provides the top surface 408 of the belt 400 on which the web is creped during the creping operation of the papermaking process. An opening 406 is formed in the polymeric top layer 402, as described above. Note that the opening 406 extends through the thickness of the polymeric top layer 402 from the top surface 408 to the surface facing the fabric bottom layer 404. As the woven fabric bottom layer 404 has a certain permeability, a vacuum can be applied to the woven fabric bottom layer 404 side of the belt 400, and thus, draw an airflow through the opening 406 and the woven fabric bottom layer 404. During the creping operation using the belt 400, cellulosic fibers from the web are drawn into the opening 406 in the polymeric top layer 402, which will result in a dome structure being formed in the web (as will be described more fully below). A vacuum may additionally be used to draw the web into the opening 406.

Figure 3B:
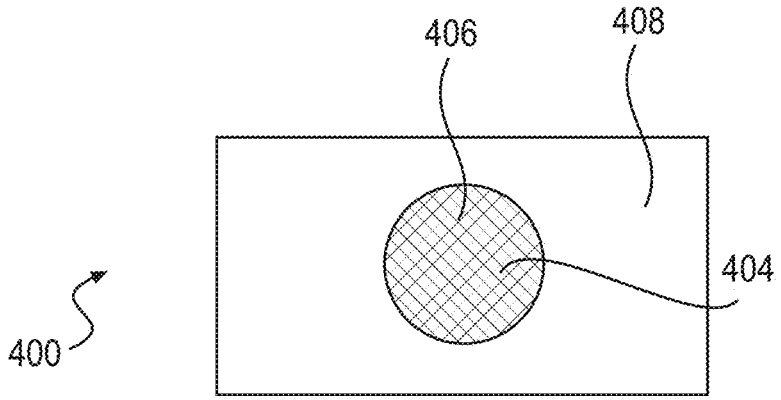
FIG. 3B is a top view of the portion of shown in FIG. 3A.

FIG. 3B is a top view of the belt 400 looking down on the portion with the opening 406 shown in FIG. 3A. As is evident from FIGS. 3A and 3B, while the woven fabric bottom layer 404 allows the vacuum to be drawn through the belt 400, the woven fabric bottom layer 404 also effectively closes off the opening 406 in the top layer. That is, the woven fabric bottom layer 404 in effect provides a plurality of openings that have a smaller cross-sectional area adjacent to the interface between the extruded polymeric top layer 402 and the woven fabric bottom layer 404. Thus, the woven fabric bottom layer 404 can substantially prevent cellulosic fibers from passing through the belt 400. As described above, the woven fabric bottom layer 404 also imparts strength, durability, and stability to the belt 400.

Figure 4A:
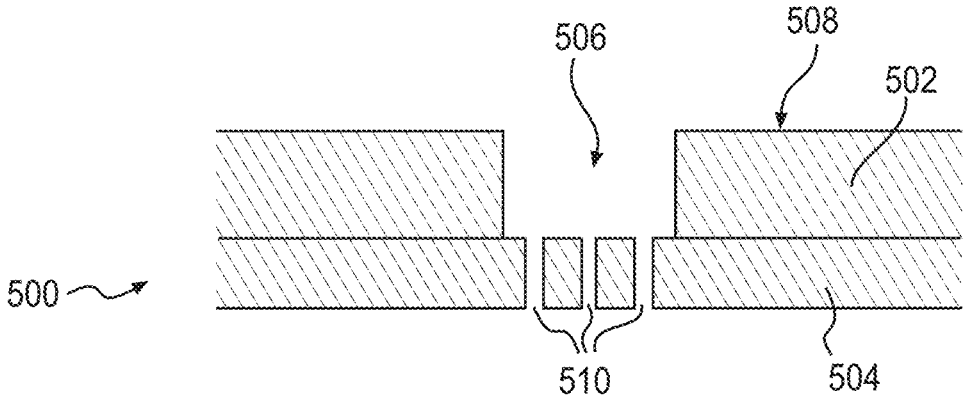
FIG. 4A is a cross-sectional view of a portion of a multilayer creping belt according to another embodiment of the invention.
Figure 4B:
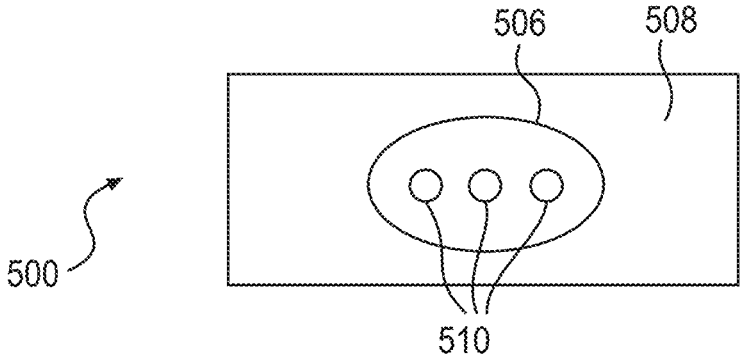
FIG. 4B is a top view of the portion of shown in FIG. 4A.

FIG. 4A is a cross-sectional view of a portion of a multilayer creping belt 500 according to an embodiment of the invention that includes an extruded polymeric top layer 502 and an extruded polymeric bottom layer 504. The polymeric top layer 502 provides the top surface 508 on which a papermaking web is creped. In this embodiment, the opening 506 in the top layer 502 is aligned with three openings 510 in the bottom layer. As is evident from the top-view of the belt portion 500 shown in FIG. 4B (with reference to FIG. 4A), the openings 510 in the polymeric bottom layer 504 have a substantially smaller cross section than the opening 506 in the polymeric top layer 502. That is, the polymeric bottom layer 504 includes a plurality of openings 510 having a smaller cross-sectional area adjacent to the interface between the polymeric top layer 502 and the polymeric bottom layer 504. This allows the extruded polymeric bottom layer 504 to function to substantially prevent fibers from being pulled through the belt structure, in the same manner as a woven fabric bottom layer described above. It should be noted, that, as indicated above, in alternative embodiments, a single opening in the extruded polymeric bottom layer 504 may be aligned with the opening 506 in the extruded polymeric top layer 502. In fact, any number of openings may be formed in the polymeric bottom layer 504 for each opening in the polymeric top layer 502.

The openings 406, 506, and 510 in the extruded polymeric layers in the belts 400 and 500 are such that the walls of the openings 406, 506, and 510 extend orthogonal to the surfaces of the belts 400 and 500. In other embodiments, however, the walls of the openings 406, 506, and 510 may be provided at different angles relative to the surfaces of the belts. The angle of the openings 406, 506, and 510 can be selected and made when the openings are formed by techniques such as laser drilling, cutting, or mechanical perforation. In specific examples, the sidewalls have angles from about 60° to about 90°, and more specifically, from about 75° to about 85°. In alternative configurations, however, the sidewall angle may be greater than about 90°. Note, the sidewall angle referred to herein is measured as indicated by the angle $\alpha$ in FIG. 3A.

The layers of the multilayer belt according to the invention may be joined together in any manner that provides a durable enough connection between the layers to allow the multilayer creping belt to be used in a papermaking process. In some embodiments, the layers are joined together by a chemical means, such as using an adhesive. A specific example of an adhesive structure that could be used to join the layers is a double coated tape. In other embodiments, the layers may be joined together by a mechanical means, such as using a hook-and-loop fastener. In still other embodiments, the layers of the multilayer belt may be joined by techniques such as heat welding and laser fusion. Those skilled in the art will appreciate the numerous lamination techniques that could be used to join the layers described herein to form the multilayer belt.

While the multilayer belt embodiments depicted in FIGS. 3A, 3B, 4A, and 4B includes two distinct layers, in other embodiments, an additional layer may be provided between the top and bottom layers shown in the figures. For example, an additional layer could be positioned between the top and bottom layers described above in order to provide a further barrier that, while allowing air to pass through the belt, prevents fibers from being pulled through the belt structure. In other embodiments, the means employed for connecting the top and bottom layers together may be constructed as a further layer. For example, an adhesive layer might be a third layer that is provided between the top layer and the bottom layer.

The total thickness of the multilayer belt according to the invention may be adjusted for the particular papermaking machine and papermaking process in which the multilayer belt is to be used. In some embodiments, the total thickness of the belt is from about 0.5 to about 2.0 cm. In embodiments of the invention that include a woven fabric bottom layer, the majority of the total thickness of the multilayer belt is provided by the extruded polymeric top layer. In embodiments of the invention that include extruded polymeric top and bottom layers, the thicknesses of each of the two layers can be selected as desired.

As discussed above, an advantage of the multilayer belt structure is that the strength, stretch resistance, dimensional stability, and durability of the belt can be provided by one of the layers, while the other layer need not significantly contribute to these parameters. The durability of the multilayer belt materials according to the invention was compared to the durability of other potential belt making materials. In this test, the durability of the belt materials was quantified in terms of the tear strength of the materials. As will be appreciated by those skilled in the art, the combination of both good tensile strength and good elastic properties results in a material with high tear strength. The tear strength of seven samples of the top and bottom layer belt materials described above was tested. The tear strength of a structuring fabric used for creping operations was also tested. For these tests, a procedure was developed based, in part, on ISO 34-1 (Tear Strength of Rubber, Vulcanized or Thermoplastic-Part 1: Trouser, Angle and Crescent). An Instron® 5966 Dual Column Tabletop Universal Testing System by Instron Corp. of Norwood, Mass. and BlueHill 3 Software also by Instron Corp. of Norwood, Mass., were used. All tear tests were conducted at 2 in./min (which differs from ISO 34-1 which uses a 4 in./min rate) for a tear extension of 1 in. with an average load being recorded in pounds.

The details of the samples and their respective MD and CD Tear strengths are shown in TABLE 3. Note that a designation of "blank" for a sample indicates that the sample was not provided with openings, and designation of "prototype" means that the sample had not yet been made into an endless belt structure, but rather, was merely the belt material in a test piece. Fabrics A and B were woven structures configured for creping in a papermaking process.

TABLE 3

| Sample | Composition | MD Tear Strength (Average Load, lbf) | CD Tear Strength (Average Load, lbf) |
|---|---|---|---|
| 1 | 0.70 mm PET (blank) | 9.43 | 5.3 |
| 2 | 0.70 mm PET (prototype) | 8.15 | 7.36 |
| 3 | 1.00 mm HYTREL ® (blank) | 20.075 | 19.505 |
| 4 | 0.50 mm PET (blank) | 3.017 | 2.04 |
| 5 | Fabric A | 20.78 | 16.26 |
| 6 | Fabric B | 175 | 175 |

As can be seen from the results shown in TABLE 3, the fabrics and the HYTREL® material had much greater tear strengths than the PET polymeric materials. As described above, a woven fabric or an extruded HYTREL® material layer can be used to form one of the layers of the multilayer belt according to the invention. The overall tear strength of the multilayer belt structure will necessarily be at least as strong as any of the layers. Thus, multilayer belts that include a woven fabric layer or an extruded HYTREL® layer will be imparted with good tear strength regardless of the material used to form the other layer or layers.

As noted above, embodiments of the invention can include an extruded polyurethane top layer and a woven fabric bottom layer. The MD tear strength of such combinations was evaluated, and also compared to the MD tear strength of a woven structuring fabric used in a creping operation. The same testing procedure was used as with the above-described tests. In this test, Sample 1 was a two-layer belt structure with a 0.5 mm thick top layer of extruded polyurethane having 1.2 mm openings. The bottom layer was a woven J5076 fabric made by Albany International, the details of which can be found above. Sample 2 was a two-layer belt structure with a 1.0 mm thick top layer of extruded polyurethane having 1.2 mm openings and J5076 fabric as the bottom layer. The tear strength of the J5076 fabric by itself was also evaluated as Sample 3. The results of these tests are shown in TABLE 4.

TABLE 4

| Sample | MD Tear Strength (average load, lbf) |
|---|---|
| 1 | 12.2 |
| 2 | 15.8 |
| 3 | 9.7 |

As can be seen from the results in TABLE 4, the multilayer belt structure with an extruded polyurethane top layer and a woven fabric bottom layer had excellent tear strength. When considering the tear strength of the woven fabric alone, it can be seen that a majority of the tear strength of the belt structures was produced by the woven fabric. The extruded polyurethane provided proportionally less tear strength of the multilayer belt structure. Nevertheless, while an extruded polyurethane layer by itself would not have sufficient strength, stretch resistance, and durability, in terms of tear strength, as indicated by the results in TABLE 4, when a multilayer structure is used with an extruded polyurethane layer and a woven fabric layer, a sufficiently durable belt structure can be formed.

TABLE 5 shows the properties of eight examples of multilayer belts that were constructed according to the invention. Belts 1 and 2 had two polymeric layers for its structure. Belts 3 to 8 had top layers formed from polyurethane (PUR), and bottom layers formed from the PET fabric J5076 fabric made by Albany International (described above). TABLE 5 sets forth properties of the openings in the top layer (i.e., the "sheet side") of each belt, such as the cross-sectional areas, volumes of the openings, and angles of the sidewalls of the openings. Table 5 also sets forth properties of the openings in the bottom layer (i.e., the "air side").

TABLE 5

| Property | BELT 1 (top layer) | BELT 1 (bottom layer) | BELT 2 (top layer) | BELT 2 (bottom layer) | BELT 3 | BELT 4 | BELT 5 | BELT 6 | BELT 7 | BELT 8 |
|---|---|---|---|---|---|---|---|---|---|---|
| Top Layer Material | PET | — | PUR | — | PUR | PUR | PUR | PUR | PUR | PUR |
| Bottom Layer Material | — | PET | — | PET | Fabric | Fabric | Fabric | Fabric | Fabric | Fabric |
| Sheet Side Hole CD Diameter (mm) | 2.41 | 0.65 | 2.50 | 0.69 | 2.40 | 2.53 | 2.54 | 3.00 | 1.43 | 1.65 |
| Sheet Side Hole MD Diameter (mm) | 2.41 | 0.63 | 2.50 | 0.69 | 2.40 | 2.53 | 2.64 | 3.00 | 1.62 | 1.67 |
| Sheet Side Hole CD/MD | 1.0 | 1.0 | 1.0 | 1.0 | 1.0 | 1.0 | 1.0 | 1.0 | 0.9 | 1.0 |
| Sheet Side Hole Cross-Sectional Area ($mm^2$) | 4.57 | 0.32 | 4.91 | 0.37 | 4.53 | 5.02 | 5.27 | 7.07 | 1.81 | 2.17 |
| Sheet Side Hole % Open Area | 73.6 | 64.1 | 82.7 | 64.5 | 80.0 | 66.9 | 67.5 | 79.3 | 79.3 | 76.4 |
| Air Side Hole CD Diameter (mm) | 1.91 | 0.35 | 2.08 | 0.36 | 2.0 | 1.96 | 1.98 | 2.41 | 1.04 | 1.07 |
| Air Side Hole MD Diameter (mm) | 1.91 | 0.35 | 2.08 | 0.36 | 2.0 | 1.96 | 1.98 | 2.41 | 1.13 | 1.07 |
| Air Side Hole CD/MD | 1.0 | 1.0 | 1.0 | 1.0 | 1.0 | 1.0 | 1.0 | 1.0 | 0.9 | 1.0 |
| Air Side Hole Cross-Sectional Area ($mm^2$) | 2.85 | 0.10 | 3.41 | 0.10 | 3.14 | 3.03 | 3.08 | 4.57 | 0.92 | 0.89 |
| Air Side Hole % Open Area | 45.9 | 19.0 | 57.4 | 17.3 | 55.5 | 40.4 | 42.9 | 43.7 | 40.3 | 31.5 |
| Sheet Side/Air Side Area Ratio | 1.6 | 3.4 | 1.4 | 3.7 | 1.4 | 1.7 | 1.7 | 1.5 | 2.0 | 2.4 |
| Side Wall Angle CD 1 (deg) | 69.0 | 73.1 | 67 | 72 | 68.1 | 74.3 | 74.4 | 78.9 | 66.4 | 75.1 |
| Side Wall Angle CD 2 (deg) | 69.0 | 73.1 | 67 | 72 | 68.1 | 74.3 | 74.4 | 78.9 | 71.5 | 72.4 |
| Side Wall Angle MD 1 (deg) | 69.0 | 73.1 | 70 | 72 | 68.1 | 74.3 | 71.7 | 78.9 | 63.9 | 73.2 |
| Side Wall Angle MD 2 (deg) | 69.0 | 73.1 | 65 | 72 | 68.1 | 74.3 | 71.7 | 78.9 | 63.9 | 73.2 |
| Volume of Openings in Top Layer ($mm^3$) | 2.60 | 0.11 | 2.18 | 0.13 | 2.01 | 4.27 | 4.63 | 8.66 | 0.76 | 1.66 |
| % Material Removed From Top Layer | 83.6 | 44.1 | 73.5 | 43.8 | 71.1 | 57.0 | 64.4 | 55.2 | 66.6 | 58.6 |
| MD Land Distance (mm) | 1.64 | 0.79 | 2.17 | 0.11 | 2.14 | 2.68 | 2.35 | 2.98 | 0.17 | 1.42 |
| MD Land/MD Diameter Ratio (%) | 67.9 | 125.7 | 86.8 | 16.5 | 89.3 | 105.9 | 89.1 | 99.2 | 10.3 | 84.8 |
| CD Land Distance | 0.65 | 0.06 | 0.04 | 0.75 | 0.09 | 0.35 | 0.34 | 0.50 | 1.14 | 0.19 |
| CD Land/CD Dia. Ratio % | 27.3 | 8.48 | 1.73 | 109.25 | 3.75 | 13.95 | 13.38 | 16.79 | 79.41 | 11.24 |
| 1/width (columns/cm) | 3.26 | 14.12 | 3.93 | 6.97 | 4.02 | 3.47 | 3.47 | 2.85 | 3.90 | 5.44 |
| 1/height (rows/cm) | 4.94 | 14.12 | 4.28 | 25.04 | 4.40 | 3.84 | 4.00 | 3.85 | 11.22 | 6.48 |
| Holes per $cm^2$ | 16 | 199 | 17 | 174 | 18 | 13 | 14 | 10 | 44 | 35 |

Processes

Another aspect of our invention is directed to processes for making paper products. The processes can utilize the multilayer belt described herein for a creping operation. In such processes, any of the papermaking machines of the general types described above may be used. Of course, those skilled in the art will recognize the numerous variations and alternative configurations of papermaking machines that can be utilized for performing the inventive processes described herein. Moreover, those skilled in the art will recognize that the well-known variables and parameters that are a part of any papermaking process can be readily determined and used in conjunction with the inventive processes, e.g., the particular type of furnish for forming the web in the papermaking process can be selected based on desired characteristics of the product.

In some processes according to the invention, the web is at a consistency (i.e., solids content) between about 15 to about 25 percent when deposited on the creping belt. In other processes according to the invention, belt creping occurs under pressure in a creping nip while the web is at a consistency between about 30 to about 60 percent. In such processes, a papermaking machine may have, for example, the configuration shown in FIG. 1 and described above. Details of such a process can be found in the aforementioned U.S. Patent Application Pub. No. 2010/0186913, which matured into U.S. Pat. No. 8,293,072. In this process, the web consistency, a velocity delta occurring at the belt-creping nip, the pressure employed at the creping nip, and the belt and nip geometry act to rearrange the fiber while the web is still pliable enough to undergo structural change. Without intending to be bound by theory, it is believed that the slower forming surface speed of the creping belt causes the web to be substantially molded into openings in the creping belt, with the fibers being realigned in proportion to the creping ratio. Some of the fibers are moved to the CD orientation, while other fibers are folded to MD ribbons. As a result of this creping operation, high caliper sheets can be formed. The multilayer belt described herein is well-suited for these processes. In particular, as described above, the multilayer belt may be configured so that the openings have a wide range of sizes, and thus, can effectively be used with these processes.

A further aspect of processes according to the invention is the application of a vacuum to the multilayer creping belt. As described above, a vacuum may be applied as the web is deposited on the creping belt in a paper making process. The vacuum acts to draw the web into the openings in the creping belt, that is, the openings in the top layer in the multilayer belt according to the invention. Notably, in processes both with and without the use of a vacuum, the web is drawn into the plurality of openings in the top layer of the multilayer belt structure, but the web is not drawn into the bottom layer of the multilayer belt structure. In some of the embodiments of the invention, the applied vacuum is about 5 in. Hg to about 30 in. Hg. As described in detail above, the bottom layer of the multilayer belt acts as a sieve to prevent fibers from being pulled through the belt structure. This bottom layer sieve functionality is particularly important when a vacuum is applied, as fibers are prevented from being pulled through to the structure that creates the vacuum, i.e., the vacuum box.

Paper Products

Other aspects of our invention are novel paper products that are not capable of being produced using previously-known papermaking machines and processes known in the art. In particular, the multilayer belt described herein allows for the formation of paper products that demonstrate superior properties and characteristics that have not been previously found in paper products made with known papermaking machines and papermaking processes.

It should be noted that the paper products referred to herein encompass all grades of products. That is, some embodiments of the invention are directed to tissue grade products, which, in general, have a basis weight of less than about 27 lbs/ream and a caliper of less than about 180 mils/8 sheets. Other embodiments of the invention are directed to towel grade products, which, in general, have a basis weight of greater than about 35 lbs/ream and a caliper of greater than about 225 mils/8 sheets.

Figure 5A:
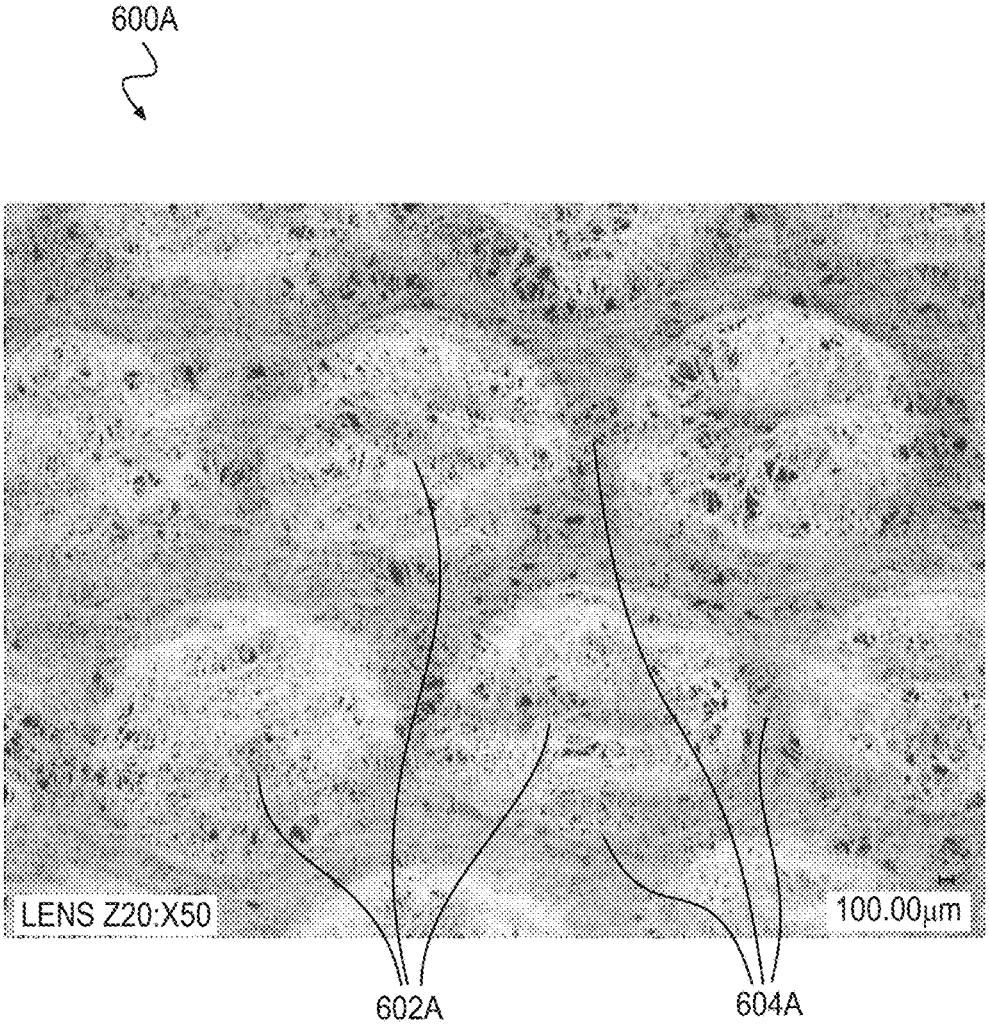
FIGS. 5A to 5C are top views of micrographs (50×) of the belt-side of absorbent cellulosic sheets according to embodiments of the invention.
Figure 5B:
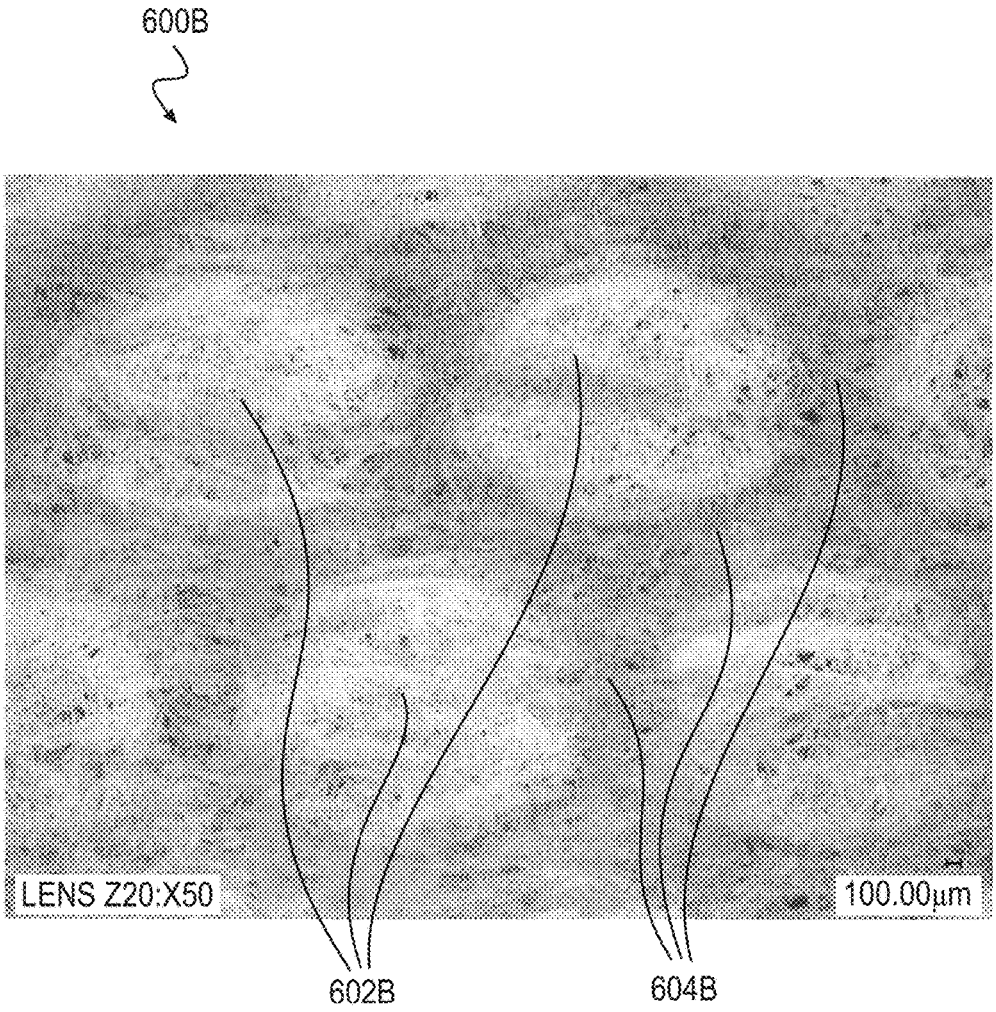
Figure 5C:
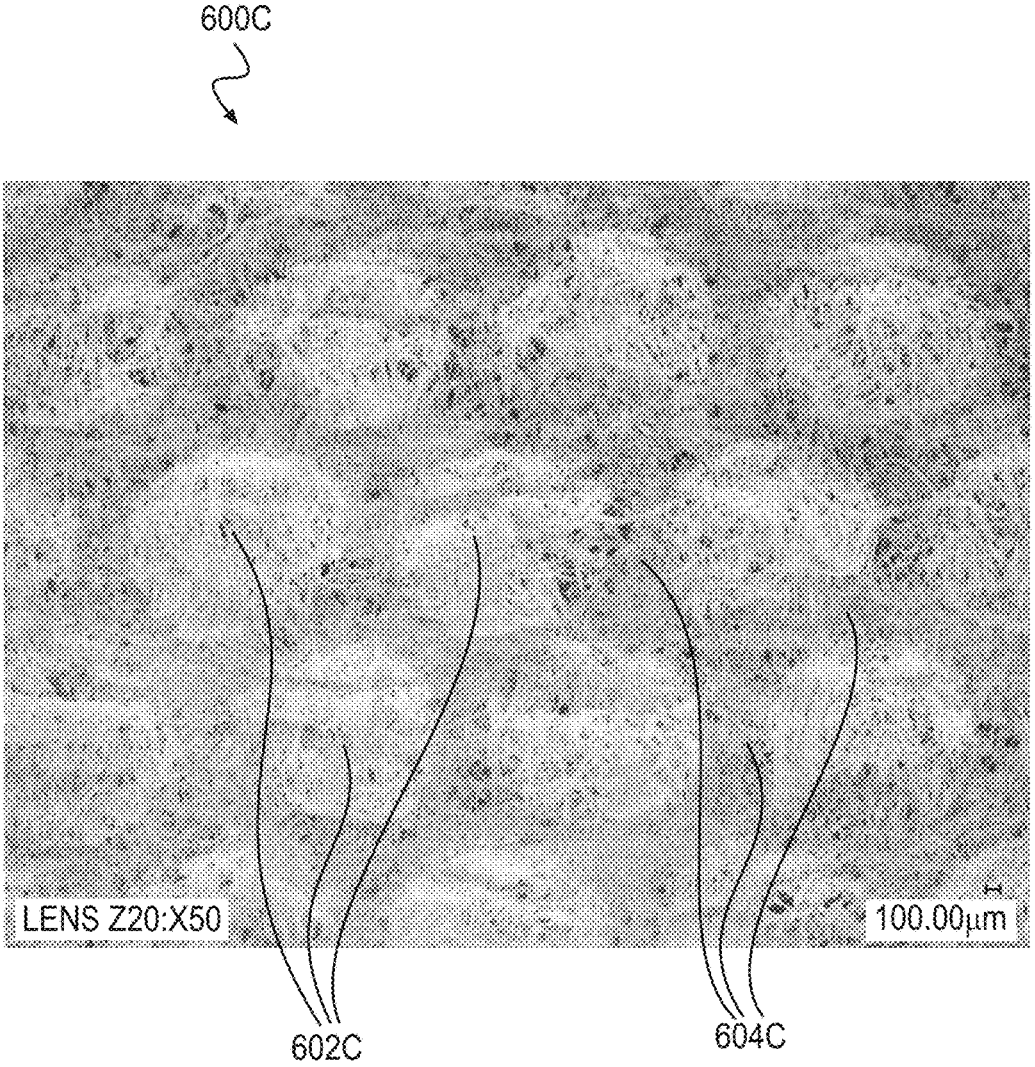
Figure 6A:
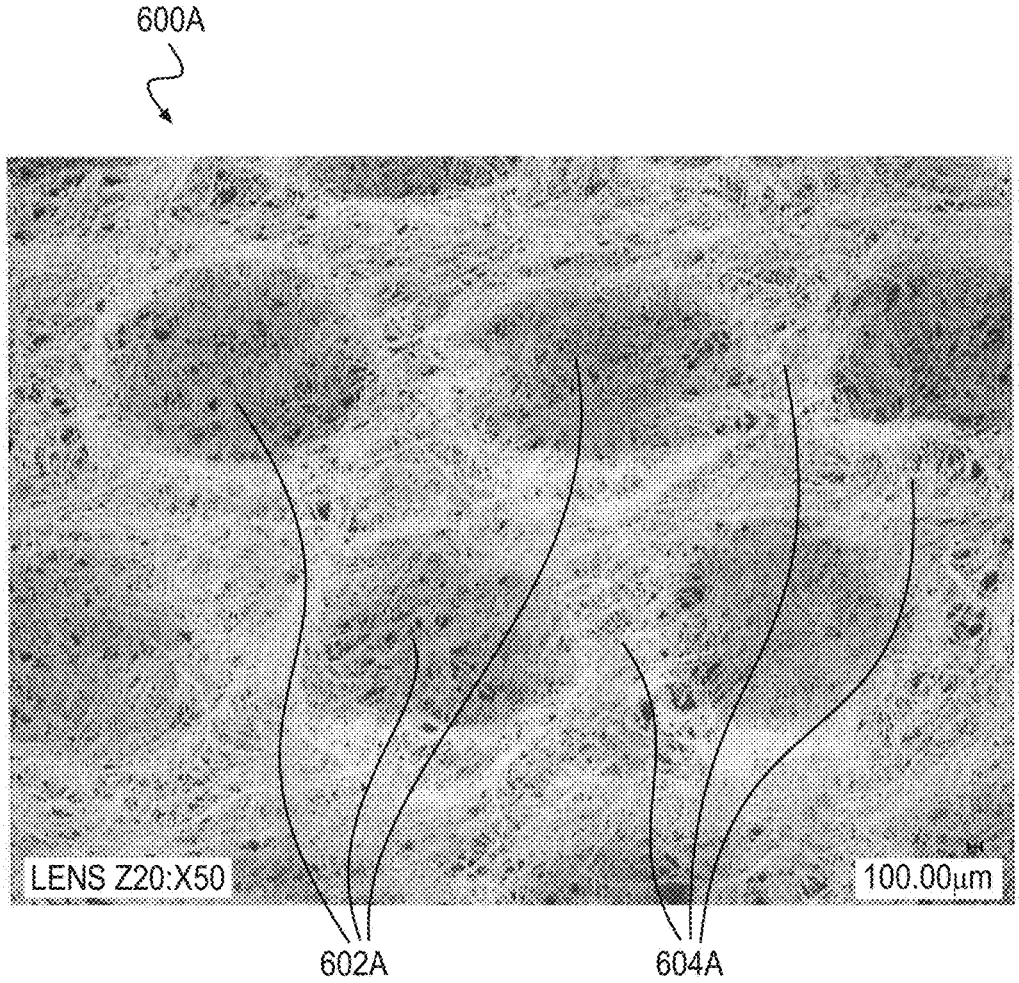
FIGS. 6A to 6C are bottom views of micrographs (50×) of the other side of absorbent cellulosic sheets shown in FIGS. 5A to 5C.
Figure 6B:
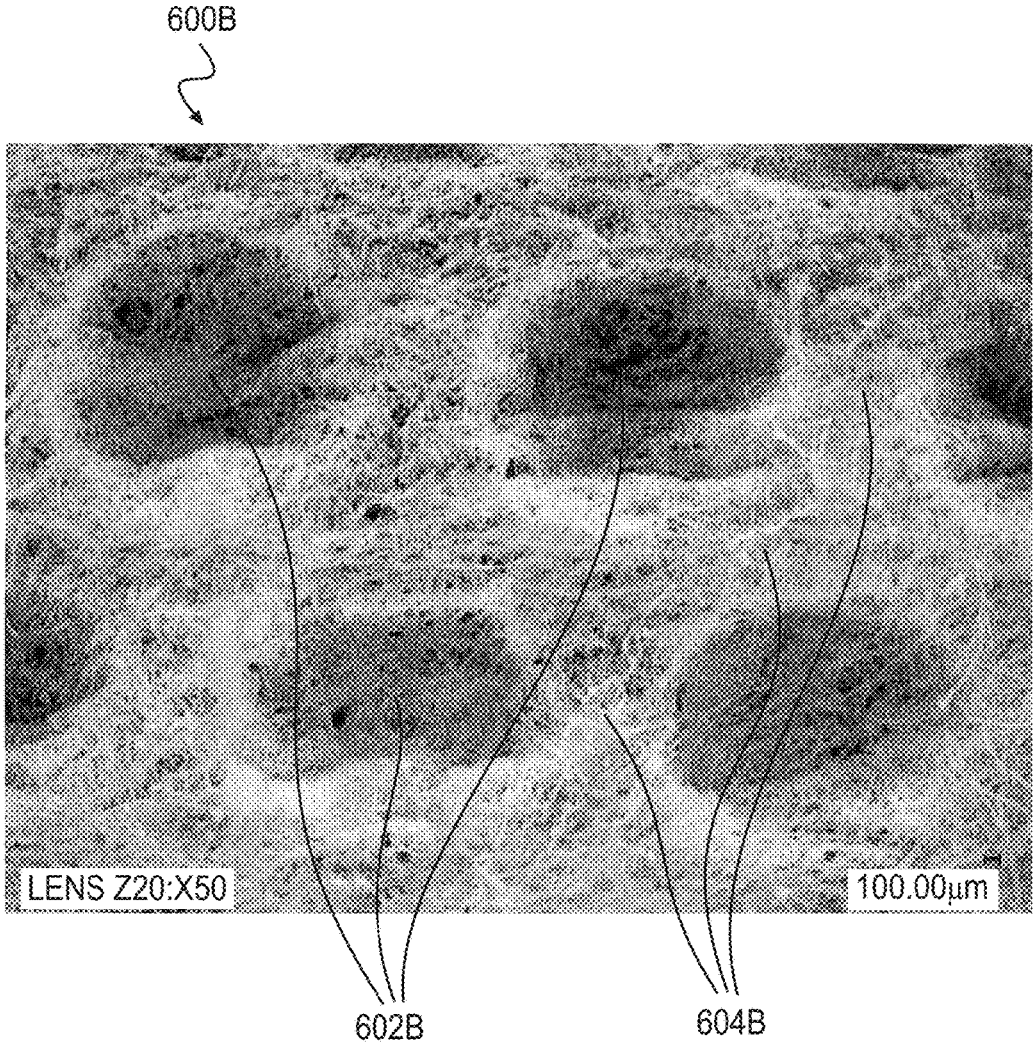
Figure 6C:
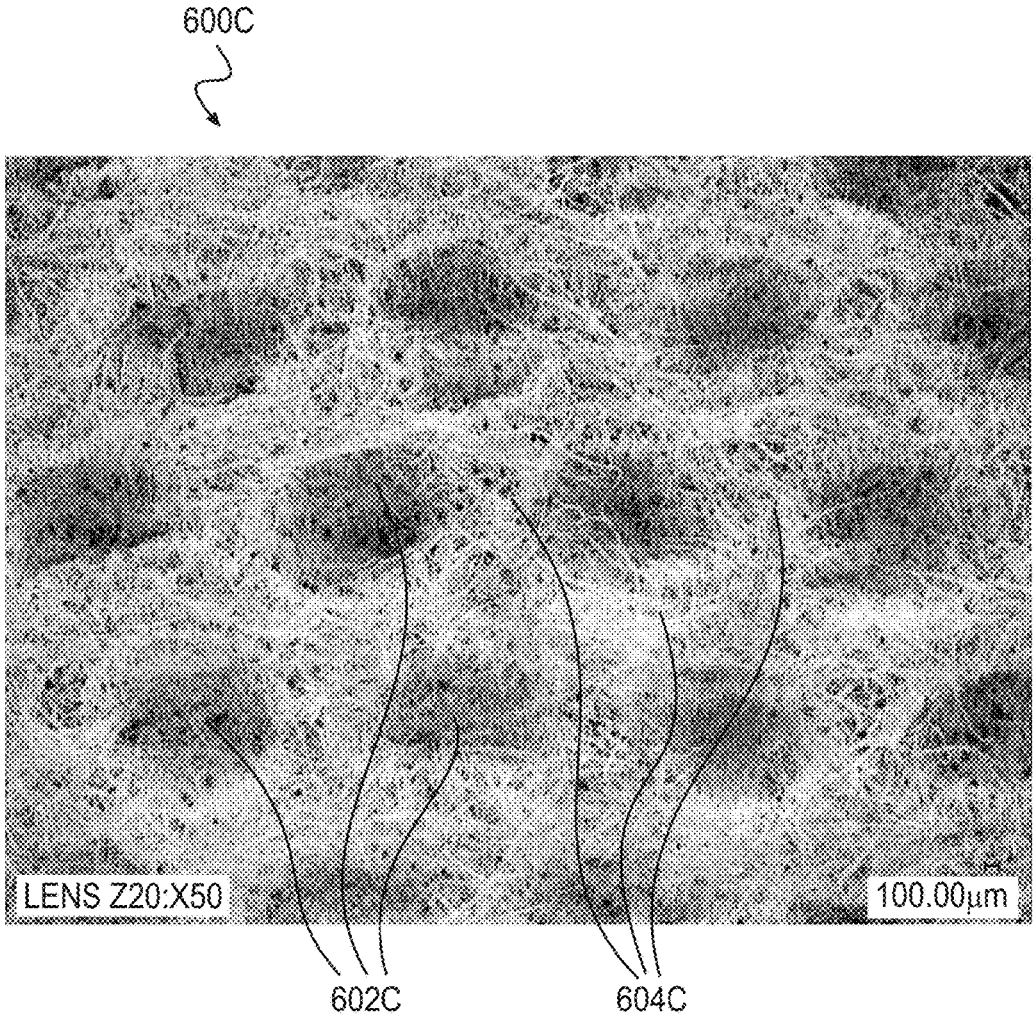

FIGS. 5A, 5B, and 5C show top views from photomicrographs (10×) of a portion of a basesheet made using multilayer belts according to the invention. In these figures, the side of the sheet that is formed against the belt, i.e., against the top surface formed by the top layer, is shown. The basesheet 600A shown in FIG. 5A was made with BELT 2, as described above, the basesheet 600B shown in FIG. 5B was made with BELT 3, as described above, and the basesheet 600C shown in FIG. 5C was made with BELT 7, as described above. The belts were used in the creping operation forming the basesheets 600A, 600B, and 600C with a papermaking machine having the general configuration shown in FIG. 1. The basesheets 600A, 600B, and 600C include a plurality of fiber-enriched domed regions 602A, 602B, and 602C arranged in a regular repeating pattern. These dome regions 602A, 602B, and 602C correspond to the pattern of openings in the top surface of the multilayer belts used to make each sheet. Domed regions 602A, 602B, and 602C are spaced from each other and interconnected by a plurality of surrounding areas 604A, 604B, and 604C, which form a consolidated network and have less texture FIGS. 6A, 6B, and 6C show the reverse side of the basesheets 600A, 600B, and 600C shown in FIGS. 5A, 5B, and 5C, respectively. FIGS. 7A(1), 7A(2), 7B(1), 7B(2), 7C(1), and 7C(2) show magnified views (100×) of a dome region for each of the basesheets 600A, 600B, and 600C, respectively. It will be seen in the various Figures that the minute folds form ridges on the dome regions 602A, 602B, and 602C and furrows or sulcations on the side opposite to the dome side of the sheet. In other photomicrographs, it will be apparent that the basis weight in the domed regions can vary considerably from point-to-point. Fiber orientations in the regions of the basesheets 600A, 600B, and 600C can also be seen in the figures. Qualitatively speaking, it can be seen that a substantial amount of fiber has been formed in the dome regions 602A, 602B, and 602C. This is particularly notable given that the dome regions 602A, 602B, and 602C are larger than the dome regions that would be found in basesheets made with other creping structures, due to the larger opening sizes that are found in the multilayer belts.

Figure 8A:
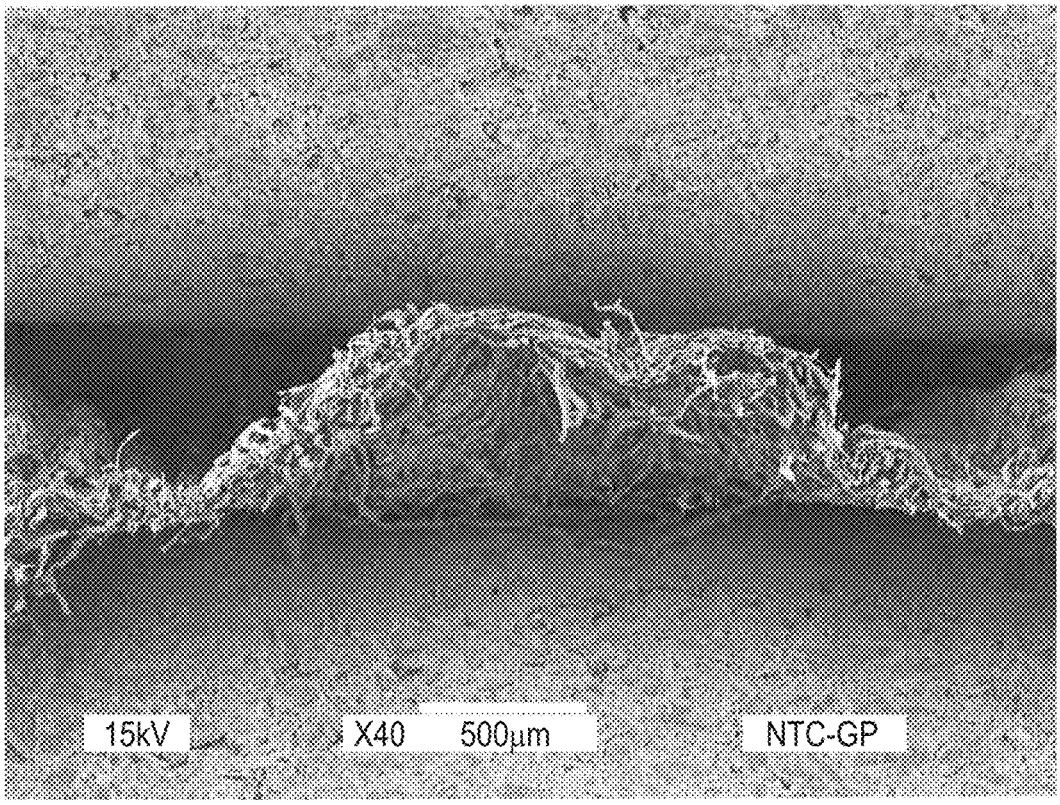
FIGS. 8A to 8C are cross-sectional views of micrographs (40×) of dome structures of absorbent cellulosic sheets according to embodiments of the invention.
Figure 8B:
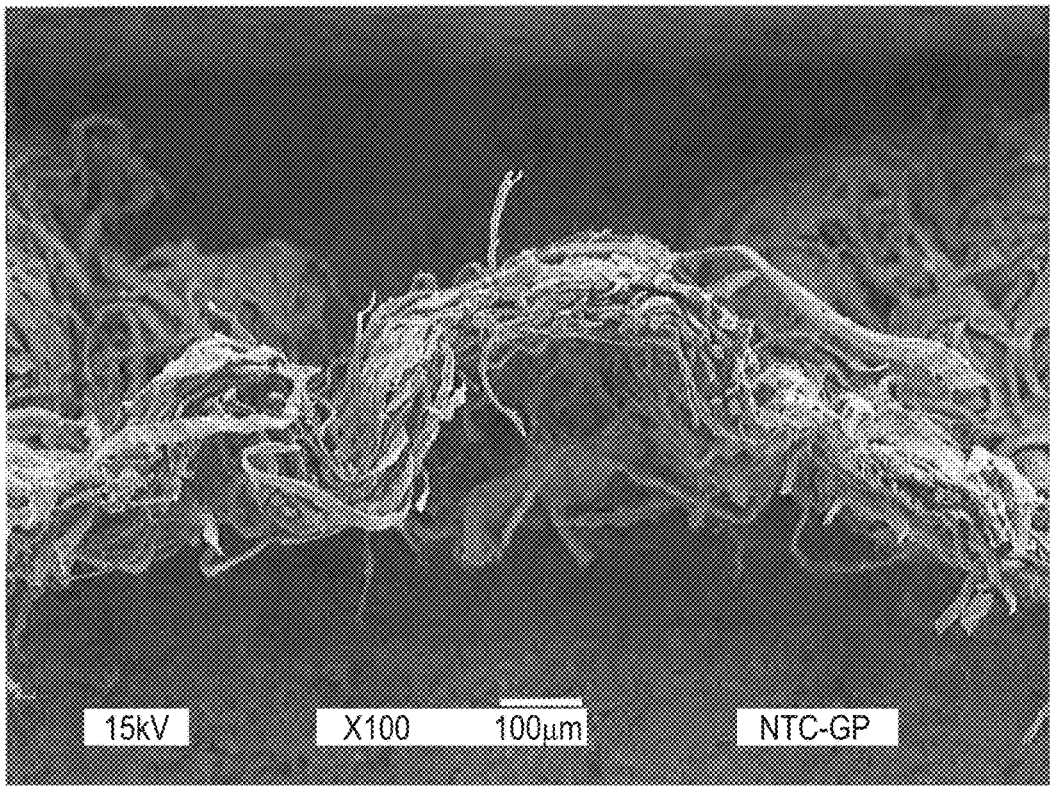
Figure 8C:
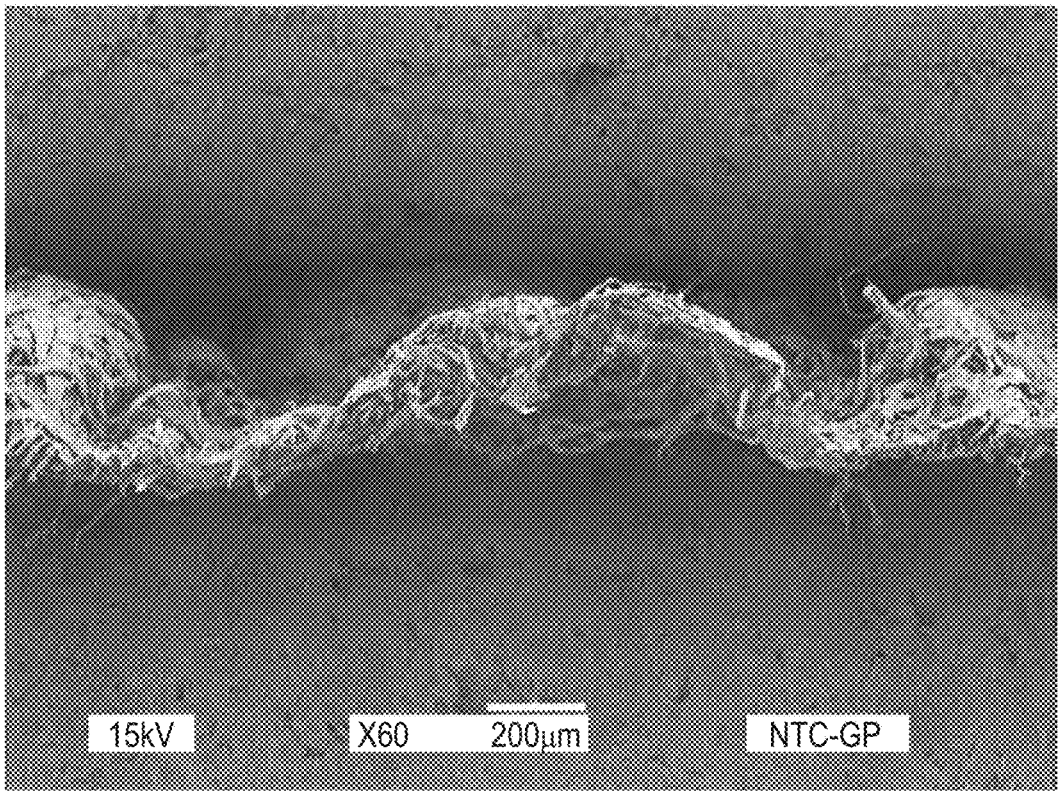

FIGS. 8A, 8B, and 8C are cross-sectional views of the dome regions in basesheets 900A, 900B, and 900C that were made according to embodiments of the invention, with the cross sections being taken along the MD of the basesheets. The basesheet 900A shown in FIG. 8A was made with BELT 3, as described above, the basesheet 900B shown in FIG. 8B was made with BELT 6, as described above, and the basesheet 900C shown in FIG. 8C was made with BELT 7, as described above. In each of FIGS. 8A and 8C, the leading edge, in terms of the direction that the basesheets were produced, is shown on the right side of the figures, with the trailing edge shown on the left side of the figures. In FIG. 8B, the leading edge is shown on the left side of the figure and the trailing edge is shown in the right side of the figure.

The figures demonstrate, once again, that a substantial amount of fiber is found in the dome regions of the sheets. Also of note is the angles of the leading and trailing edges of the dome regions. The leading edges show a much shallower angle than the relative steep trailing edge.

It should be noted that the dome regions 602A, 602B, and 602C shown in FIGS. 5A to 5C, 6A to 6C, 7A(1) to 7C(3), and 8A to 8C have a substantially circular shape when viewed from one of the sides of the sheet. As indicated by the disclosure herein, however, the shape of the dome structures in paper products according to the invention can be varied to any other shape be varying the corresponding shape of the openings in the creping structure used to form the openings, i.e., the creping belt or structuring fabric.

As discussed above, one of the advantages of using a multilayer belt configuration is the ability to form large openings in the top layer of the belt that provides the creping surface without substantially reducing the durability of the belt, and while still preventing a substantial amount of fiber from pulling through the belt during the papermaking process. In fact, the multilayer belt structure allows for the formation of openings that would not be possible with pockets of fabrics or openings in monolithic belts. The result is that the dome regions in the products formed with the multilayer belt, such as those shown in FIGS. 5A to 5C, 6A to 6C, 7A(1) to 7C(3), and 8A to 8C, are formed with a much larger size than the dome regions in paper products formed with other creping structures, such as monolithic belts and structuring fabrics.

Figure 9:
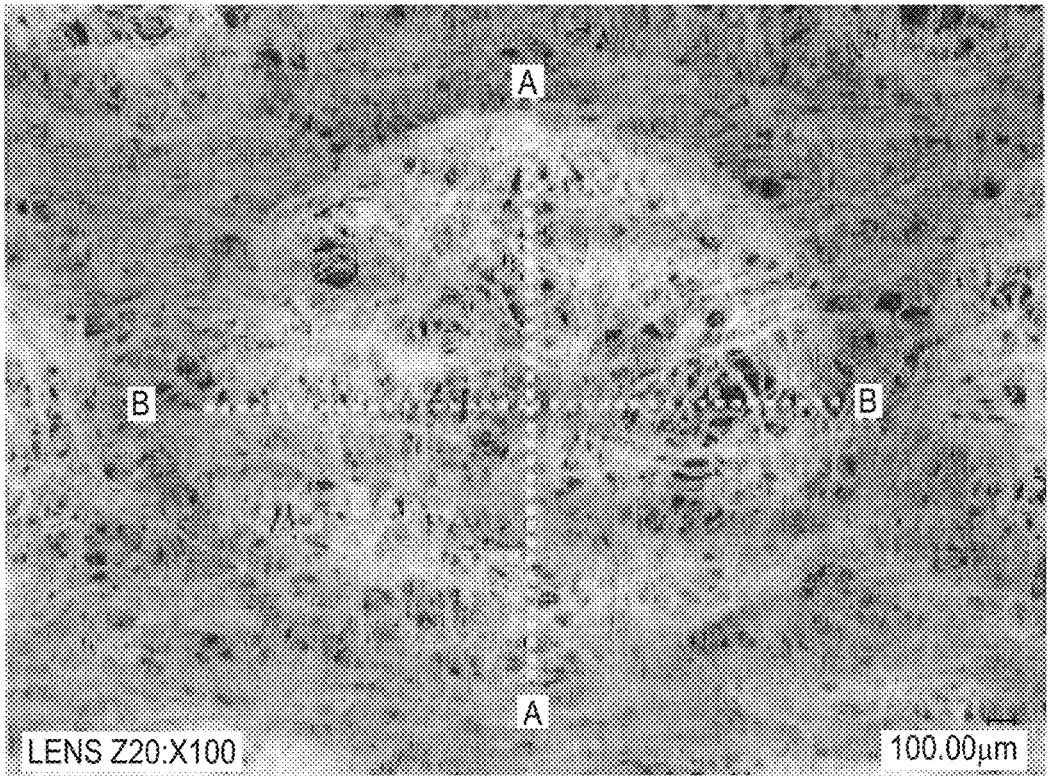
FIG. 9 is a view of a measurement of the size of a dome region in a paper product according to the invention.

In order to quantify the size of the dome regions of paper products according to the invention, a distance can be measured from one point on the edge of a dome to another point on the edge at the opposite side of the dome. An example of such a measurement is shown by lines A and B in FIG. 9. This measurement can be taken, for example, by viewing the dome of a paper product next to a scale under a microscope. (One example of a microscope that can be used in this technique is a Keyence VHX-1000 Digital Microscope, made by Keyence Corporation of Osaka, Japan.) In embodiments of paper products according to the invention, the distance from at least one point on the edge of a hollow dome region to a point on the edge at the opposite side of the hollow domed region is at least about 0.5 mm. In more specific embodiments, the measured distance is about 1.0 mm to about 4.0 mm, and in still more specific embodiments, the measured distance is about 1.5 mm to about 3.0 mm. In a particular embodiment, the distance from at least one point on the edge of a hollow dome region to a point on the edge at the opposite side of the hollow domed region is about 2.5 mm. As again will be appreciated by those skilled in the art, domes of these sizes could not be formed with other creping structures known in the art, such as monolithic belts and structuring fabrics.

Another manner of characterizing the dome regions in paper products according to the invention is the volume of the dome structures. In this regard, references to "volume" of a dome region herein indicates the volume of the portion of the paper product that is the dome region, as well as a hollow region defined by the dome region. Those skilled in the art will appreciate that this volume could be measured using different techniques. An example of one such technique uses a digital microscope to measure the volume of a plurality of layers in the paper product. The sum of the layers in the region making up the dome region can then be calculated to thereby calculate the total volume of the dome region.

In embodiments of the invention, the dome regions have a volume of at least about 0.1 $mm^3$, and sometimes, the dome regions have a volume of at least about 1.0 $mm^3$. In specific embodiments, the dome regions have volumes from about 1.0 $mm^3$ to about 10.0 $mm^3$. Other specific examples of paper products according to the invention have dome regions with volumes from about 0.1 $mm^3$ to about 3.5 $mm^3$, and more specifically, about 0.2 $mm^3$ to about 1.4 $mm^3$. Yet again, it should be noted that dome regions of these sizes could not be produced using creping structures known in the art, such as monolithic belts and structuring fabrics.

The large dome regions formed in the paper products according to the invention significantly affect the caliper of the paper products. As will be demonstrated in experimental results presented below, larger dome regions will result in the paper product having more caliper, which is highly desirable in papermaking processes. The particular basesheets shown in FIGS. 5A to 5C, 6A to 6C, 7A(1) to 7C(3), and 8A to 8C had calipers of at least about 140 mils/8 sheets, which is a relatively-high amount of caliper. Further, as demonstrated above, the dome regions in the basesheets contained a substantial amount of fibers. It is believed that such calipers could not be achieved using conventional creping structures and creping processes, at least without using substantially more fiber than is necessary to form the corresponding amount of caliper in paper products according to the invention. In specific examples, paper products with the aforementioned dome sizes, both in terms of distances across the domes and volume of the domes, have a caliper of at least about 130 mils/8 sheets, about 140 mils/8 sheets, about 145 mils/8 sheets, or even about 245 mils/8 sheets. Specific examples of such paper products will be described below. And, even if the caliper is generated using conventional creping structures and creping processes, the fiber distribution is different than that in the paper products according to the invention, e.g., not nearly as much of the fibers would be found in the dome regions of the conventionally-made paper products.

Yet another novel aspect of the dome structures of paper products according to the invention involves the fiber density found in different parts of the dome structure. To understand these aspects of our invention, a technique can be used to provide an approximation of the local fiber density in paper products, such as those of our invention, at resolutions on the order of the base resolution of three dimensional X-ray micro-computed tomographic (XR-μCT) representations obtained from synchrotron or laboratory instruments. An example of such a laboratory instrument is the MicroXCT-200 by XRadia, Inc. of Pleasanton, Calif. Specifically, with the technique described below, a perpendicular (normal) fiber density can be determined at a center surface of a paper product. Note, the fiber density may vary in the out-of-plane direction due to embossments, creping, drying features, etc.

With the fiber density determination technique, XR-μCT data sets are received after they have undergone a Radon Transform or a John Transform to convert radially projected X-ray images into three-dimensional data sets consisting of stacks of two-dimensional gray level images. For example, paper product data received from the synchrotron at the European Synchrotron Radiation Facility in Grenoble, France, consists of 2000 slices, each with dimensions of 2000x~800 pixels with eight bit gray level values. The gray level values represent the attenuation of mass, which, for a material of a relatively uniform molecular mass, closely approximates the three-dimensional distribution of mass or formation. Paper products consist principally of cellulosic fibers, so an assumption of a constant X-ray attenuation coefficient, and therefore a direct relationship between gray level and mass, is valid.

XR-μCT data sets generated from the Radon or John Transform show the void space as a finite gray level value, and mass at a higher gray level value, in a range from 0 to 255. The slice images also show visible artifacts that originate when the paper product sample moves during the exposure, or from imprecise movement of the rotational or z-positioning stage. These artifacts appear as lines projecting from the mass in various orientations. If the paper product sample is rotated within the X-ray beam on an axis perpendicular to the principal plane of the paper product sample, it may also contain a "ringing" artifact, and a center "pin" of a higher gray level that must be addressed, since this indicates mass that does not exist in the paper product sample. In particular, this may be the case for XR-μCT data sets received from a synchrotron.

A segmentation process refers to the separation of different phases of the material contained in a paper product sample. This is merely distinguishing between solid cellulose fibers and air (void space). In order to obtain representative tomographic data sets, the following segmentation process can be employed using the open software called ImageJ which is a public domain, image processing program developed at the United States National Institute of Health. First, slices are subjected to two "de-speckle" filtering processes, wherein each pixel is replaced by the median value for the 3×3 surrounding neighbors. This removes salt and pepper noise (high and low values), especially, the artifacts described above, and has a negligible effect of increasing the line spread function at the edge of cellulose fibers. Next, the gray level histogram is adjusted by thresholding the lower value (black) so that the void space is clipped to values of zero (black), and the gray level values for mass span the remaining gray level histogram. Care can be taken not to set the threshold at a value that is too high, otherwise, mass at the fiber edge will be converted to void space, and the fiber will appear to lose cross-sectional area. All slices are treated in the same manner, so that a data set is generated that clearly distinguishes between fiber mass and void space.

Relative density of a paper product sample can be calculated from the preprocessed XR-μCT data sets by first generating surfaces that approximate the upper and lower boundaries of the sample, and then calculating a center surface between the two. Surface normal vectors, which are determined at each position within the center surface, are then used to determine the mass per volume within a cylinder that is 1×1 pixels times the distance (in pixels) between the upper and lower surface along the surface normal vector. All calculations can be performed using MATLAB® by MathWorks, Inc. of Natick, Mass. A specific procedure includes surface determination, surface normals and three-dimensional thickness, three-dimensional density, and three-dimensional density representations, as will now be described.

For surface determination, slices in XR-μCT data sets are X-Z projections where the X-Y plane is the principal plane of the sample and is the same plane formed by the MD or CD. Therefore, the Z-axis is perpendicular to the X-Y plane and each slice represents a unit step in the Y direction. For each X position within each slice, the highest and lowest Z position, where the gray level value exceeds a limiting threshold value (typically, 20) is identified. Thus, each slice will produce a curve connecting the maximum (upper) and minimum (lower) positions of the fibers indicated in the slice.

Those regions where no mass can be found along the Z-axis, i.e., where a through-hole exists within the material, can present a problem for creating a continuous center surface. To overcome this, holes can be filled by dilating the hole (increasing the hole size) by two pixels around the periphery, and the average value can be determined for the surrounding positions that have finite Z values for maximum, minimum or center, depending on the surface being adjusted. The hole can then be filled with the average Z-position value so that no discontinuity occurs, and so that surface smoothing will not be adversely influenced by the void space.

A robust three-dimensional smoothing spline function can then be applied to each surface. An algorithm for performing this function is described by D. Garcia, Computational Statistics & Data Analysis, 54:1167-1178 (2010), the disclosure of which is incorporated by reference in its entirety. The smoothing parameter can be varied to produce a series of files that provide a range of surface smoothness that presents individual fiber detail to a greater or lesser extent.

Three-dimensional surface normals can be calculated at each vertex within the smoothed center surface using the MATLAB® function "surfnorm." The algorithm is based on a cubic fit of the x, y, and z matrices. Diagonal vectors can be computed and crossed to form the normal. Line segments, parallel to the surface normal that pass through each vertex and terminate at the upper and lower smoothed surfaces can be used to determine the thickness of a paper product sample in a direction perpendicular to the center surface.

The three-dimensional relative fiber density is determined along a pathway perpendicular to the center surface by assuming a right rectangular prism with two dimensions being one pixel and the third as the length of the line segment extending from the two external smoothed surfaces through the vertex. The mass contained within that volume is determined as the voxels have a finite mass as indicated by the gray level value from the tomographic data set. Thus, the maximum relative density at a vertex is equal to one if all of the voxels along the line segment contain have a gray level value of 255. The maximum value for the cell walls of cellulosic fibers is taken to be 1.50 g/cm$^3$.

Figure 10:
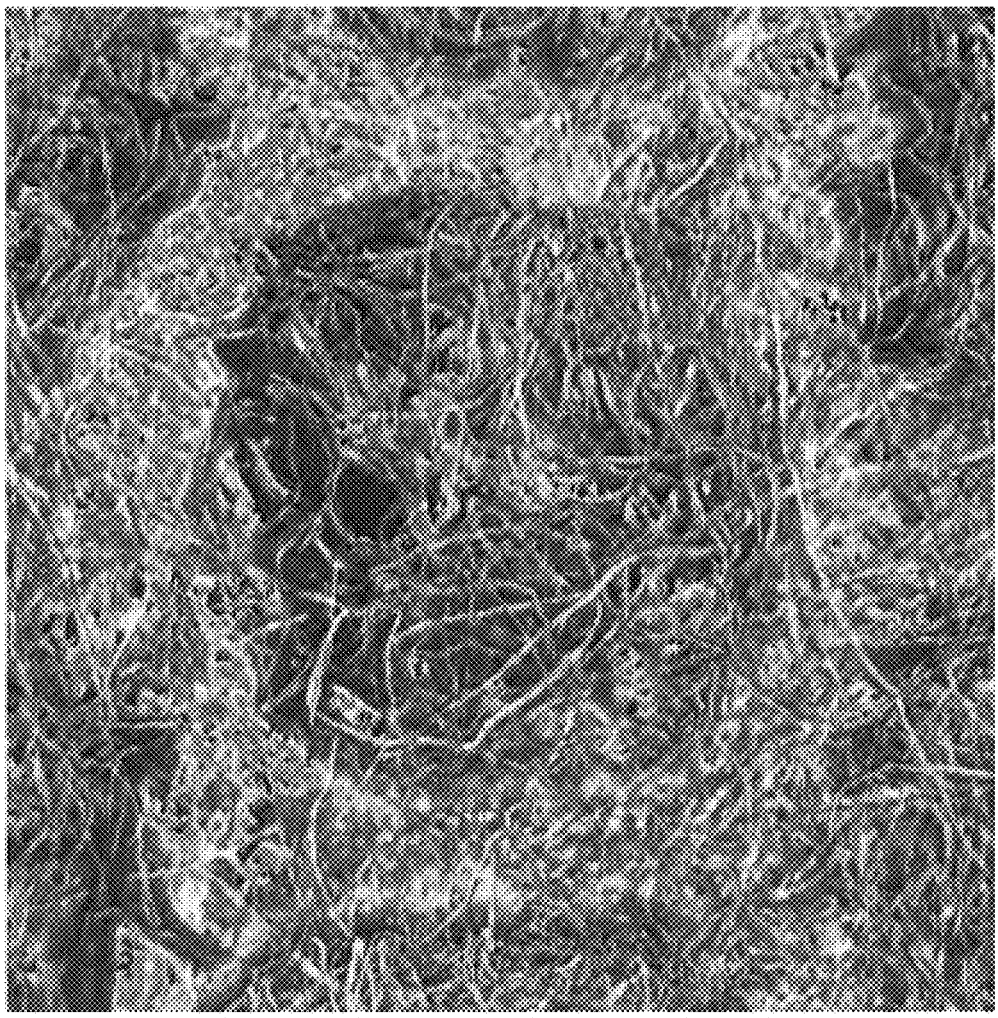
FIG. 10 is a representation of the fiber density distribution in a dome region of a paper product according to the invention.

A convenient representation of the three-dimensional fiber density can be made by mapping the fiber density in four dimensions using the smoothed center surface to show the extent of out-of-plane deformation for the sample, and indicating the three-dimensional density as a spectral plot with values at each location within the map. These maps may be shown as relative density with maximum values of 1, or normalized to the density of cellulose with a maximum of 1.50 g/cm$^3$ as indicated. An example of such a fiber density map is shown in FIG. 10.

Figure 11:
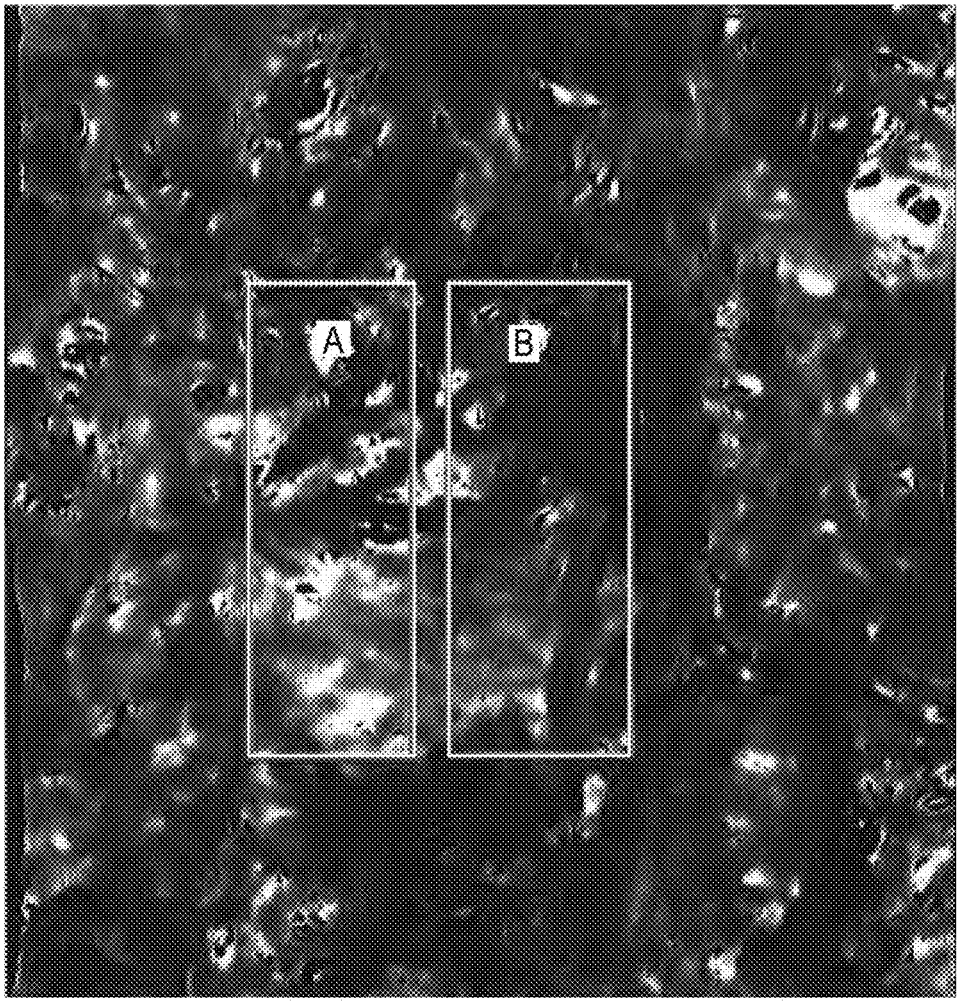
FIG. 11 is a representation, in greyscale, of the fiber density distribution in a dome region of a paper product according to the invention.

A grey scale fiber density map made according to the above-described techniques is shown FIG. 11. In this Figure, a box A has been drawn that outlines a portion of the dome structure that is formed on the downstream MD side of the dome structure, that is, the "leading side" of the dome structure. A box B has also been drawn that outlines a portion of the dome structure that is formed in the upstream MD side of the dome structure, that is, the "trailing side" of the dome structure. As the density map is formed according to the techniques described above, the darker shaded areas represent higher density, and the lighter shaded areas represent lower density. From the data used to construct the density profile map, the median density for the areas outlined in boxes A and B can be determined and compared.

It has been found that the dome structure of paper products according to the invention exhibit substantial variance in fiber density in different areas of the dome structure. In particular, a higher fiber density is formed in the trailing side of the dome structures than the fiber density formed in the leading side of the dome structures. This can be seen in example shown in FIG. 11, wherein the portion of the dome structure that is formed on the trailing side in box B has a visibly higher density than the portion of the dome structure that is formed in the leading side of the dome structure in box A. According to an embodiment of the invention, this density difference in the opposite sides of the dome structure is about 70% when determined using the x-ray tomography technique described. In other words, the leading side of the dome structure has 70% less fiber density than the trailing side of the dome structure. In another embodiment, the density difference in a paper product according to the invention has a density difference of about 75% between the trailing and leading sides of its dome structures.

Without being bound by theory, it is believed that the techniques described herein allow for the extraordinary density differences on opposite sides of the dome structures. In particular, the formation of larger domes, such as with the large-sized openings in the multilayer belts described above, allows for more fibers to flow into the openings during the creping operation. This flow of fibers leads to more fiber disruption in the leading side of the dome structures, and, thus, a lower fiber density. It is also believed that the higher density in other portions of the sidewalls of the dome structures leads to higher caliper, and might also lead to somewhat softer products because of the lower density portions of the sidewalls.

Softness and Caliper of Paper Products

An important property of any paper product is the perceived softness of the paper. In order to improve the perceived softness of a paper product, however, it is often necessary to sacrifice the quality of other properties of the paper product. For example, adjusting parameters of a paper product so as to improve the perceived softness of the paper will often have the undesirable side effect of decreasing the caliper of the paper product.

Figure 12:
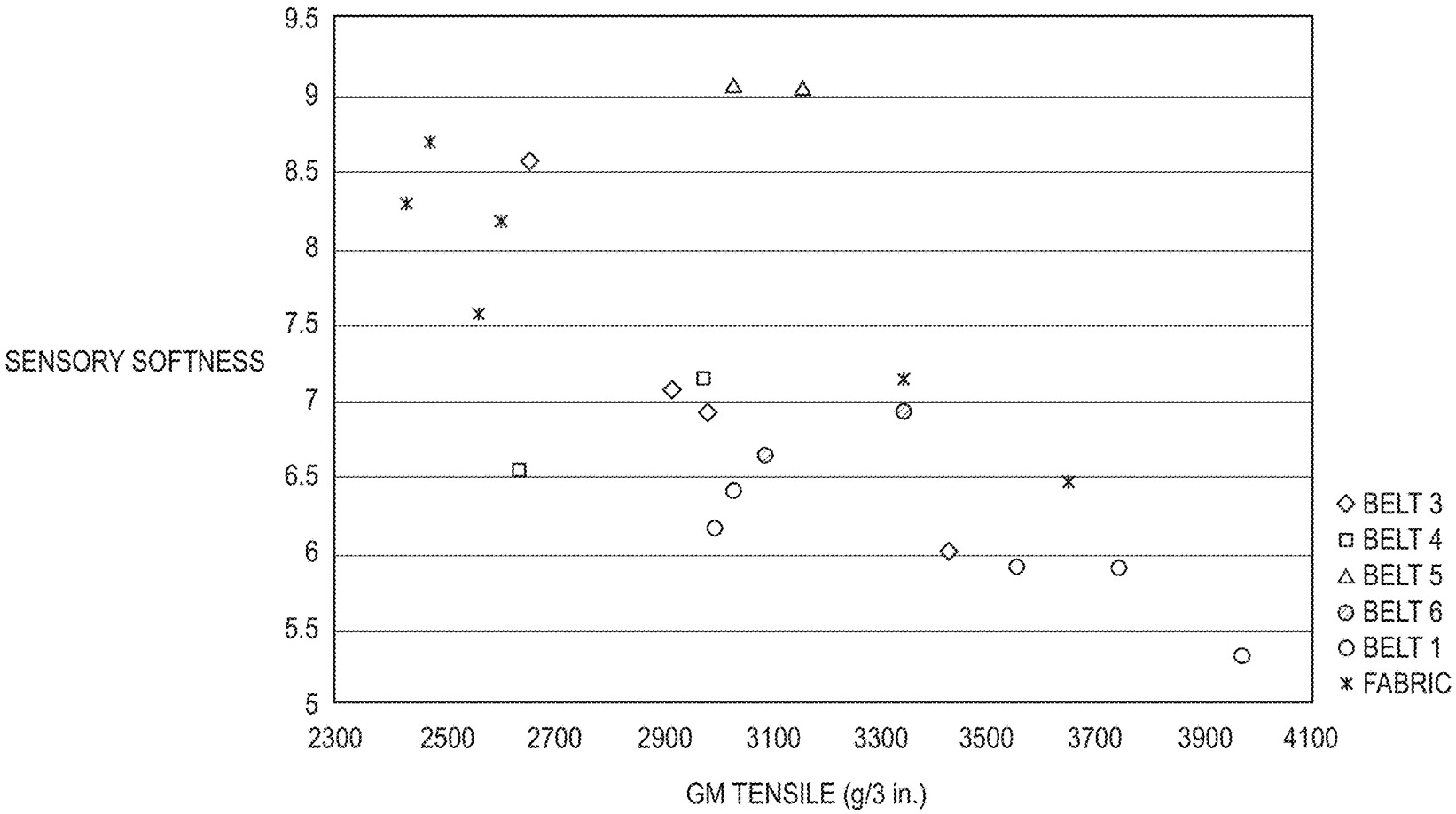
FIG. 12 is a plot of the relation between sensory softness and GM tensile for paper products.
Figure 13:
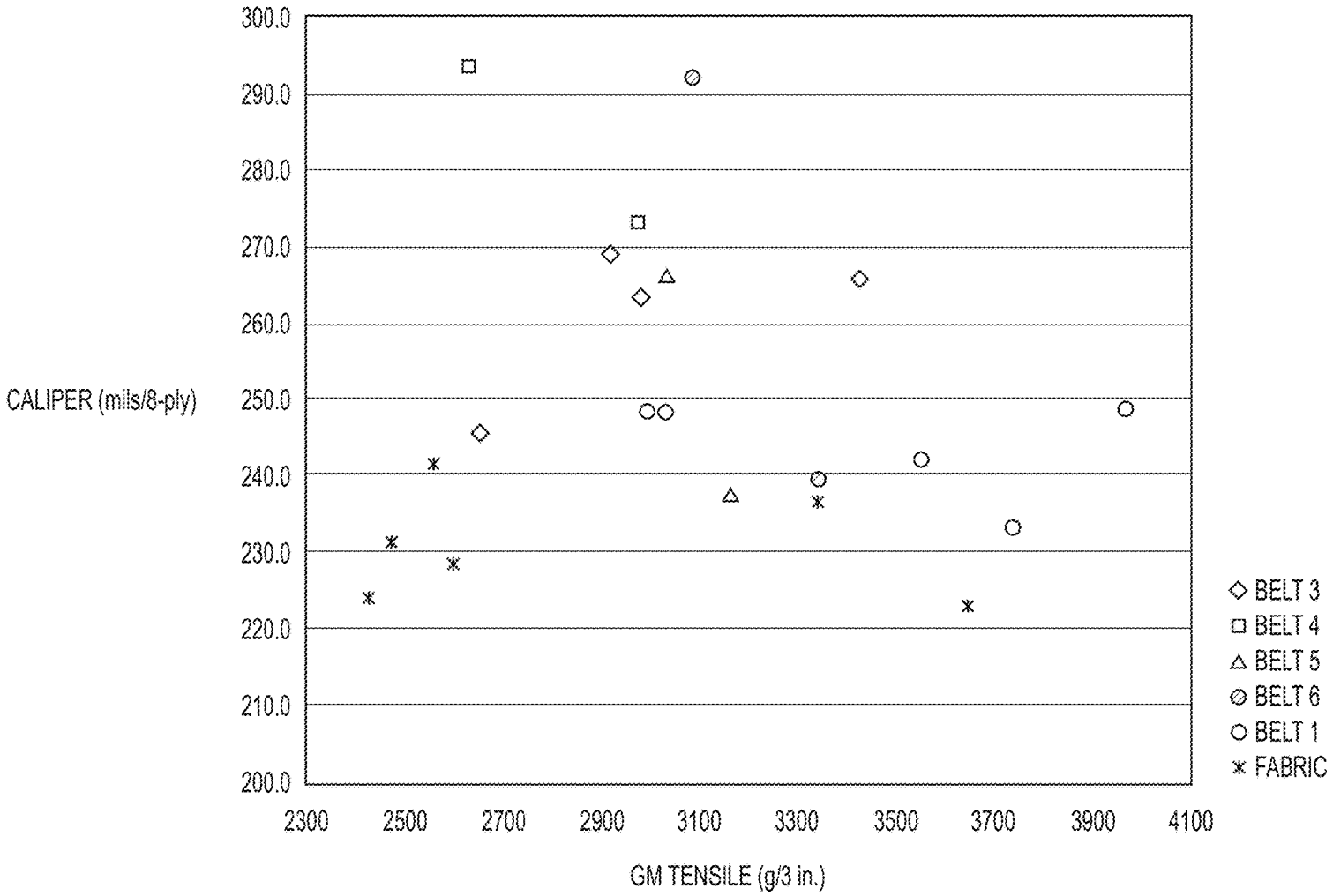
FIG. 13 is a plot of the relation between caliper and GM tensile for paper products according to the invention.

It has been found that the perceived softness of a paper product can be highly correlated to the geometric mean (GM) Tensile Modulus of the paper product. GM tensile is defined as the square root of the product of the MD tensile and CD tensile of the paper product. FIG. 12 demonstrates a correlation between the sensory softness and the GM tensile of base sheets that were made with BELTS 1 and 3 to 6 described above, and for a fabric known in the art for use in a creping operation in a paper making process. Sensory softness is a measure of the perceived softness of a paper product as determined by trained evaluators using standardized testing techniques. That is, sensory softness is measured by evaluators experienced with determining the softness, with the evaluators following specific techniques for grasping the paper and ascertaining a perceived softness of the paper. A higher the sensory softness number, the higher the perceived softness. The clear trend in paper products, as demonstrated by the data related to the base sheets shown in FIG. 13, is that as the GM tensile of a paper product is decreased, the sensory softness of the paper product is increased, and vice-versa.

The paper products according to the invention demonstrate an excellent combination of GM tensile and caliper. That is, the inventive paper products have excellent softness (low GM tensile) and bulk (high caliper). To demonstrate this combination of properties, products were made using BELTS 1 and 3 to 6, and compared to paper products made using a structuring fabric 44G polyester fabric made by Voith GmbH of Heidenheim, Germany. The 44G fabric is a well-known fabric for creping in papermaking processes.

For BELT 1, two trials with the operating conditions set forth in TABLE 6 were conducted on a papermaking machine similar to the machine shown in FIG. 1. Note, northern softwood kraft (NSWK), softwood kraft (SWK) wet strength resin (WSR), carboxymethyl cellulose (CMC), and polyvinyl alcohol (PVOH) may be abbreviated as indicated.

TABLE 6

| Furnish Blend | |
|---|---|
| Yankee-SideLayer | 80/20 NSWK/*eucalyptus*, unrefined |
| Air-Side Layer | 80/20 NSWK/*eucalyptus*, refined |
| Furnish Split | 35/65 Yankee/Air |
| Refining of Air Layer (Hp) | 27 |
| Control of Wet Strength | WSR 25 lb/ton<br>CMC 5 lb/ton |
| Control of Wet/Dry Ratio | No debonder |
| Fabric Crepe/Reel Crepe | 20%/7% |
| Yankee Speed (fpm) | 1200 |
| Molding Box Vacuum (in. Hg) | 23.7 |
| Creping Chemistry | Use PVOH and other normal coating components |
| Crepe Moisture | ~2% |
| Parent Roll Needed | 2 for each condition |

Two trials were conducted with BELT 3 and two trials were conducted with BELT 4. The trial conditions for BELTS 3 and 4 are indicated in TABLE 7, and the trials were conducted a papermaking machine similar to the machine shown in FIG. 1.

TABLE 7

| | Trial 1 | Trial 2 |
|---|---|---|
| Furnish Blend | | |
| Yankee-SideLayer | 80/20 NSWK/*eucalyptus*, unrefined | 80/20 NSWK/*eucalyptus*, unrefined |
| Air-Side Layer | 80/20 NSWK/*eucalyptus*, refined | 80/20 NSWK/*eucalyptus*, refined |
| Furnish Split | 35/65 Yankee/Air | 35/65 Yankee/Air |
| Refining of Air Layer (Hp) | 27 | ≤27 |
| Debonder, lb/ton | 6.5 | 6.5 |
| Control of Wet Strength | WSR 25 lb/ton<br>CMC 5 lb/ton | WSR ≤25 lb/ton<br>CMC ≤5 lb/ton |
| Control of Wet/Dry Ratio | 10 lb/ton debonder on Air-side | 10 lb/ton debonder on Air-side |

TABLE 7-continued

| | Trial 1 | Trial 2 |
|---|---|---|
| | No debonder on Yankee-side | No debonder on Yankee-side |
| Fabric Crepe/Reel Crepe | 20%/7% | 20%/7% |
| Yankee Speed (fpm) | 1200 | 1200 |
| Molding Box Vacuum (in. Hg) | 23.7 or Max. | 23.7 or Max. |
| Creping Chemistry | Use PVOH and other normal coating components | Use PVOH and other normal coating components |
| Crepe Moisture | ~2% | ~2% |
| Parent Roll Needed | 4 calendered rolls and 2 uncalendered rolls | 4 calendered rolls and 2 uncalendered rolls |

Two trials were also conducted using BELT 5 in a papermaking machine configuration similar to that shown in FIG. 1. For Trial 1, a 100% NSWK furnish was used in a homogeneous mode. The basis weight was targeted to be 16.8 lb/rm. A total of 3.0 lb/ton of debonder was added in the airside stock and no debonder was added in the Yankee-side stock. To ensure adequate Yankee adhesion, KL506 PVOH was used as part of the Yankee coating adhesive. The target basesheet caliper was achieved by generating the highest possible uncalendered caliper, and then calendering the result to be 125 mils/8-ply. A 550 g/in$^3$ CD wet tensile was achieved by balancing refining and add-ons of wet strength and carbox-methyl cellulose (CMC). The initial refining setting was 45 HP with the initial usages of wet strength resin and CMC at 25 and 5 lb/ton, respectively. Trial 2 using BELT 5 was the same as Trial 1, except that a furnish of 100% Naheola SWK was used.

Ten calendered rolls and two uncalendered rolls were collected in each of Trials 1 and 2 for BELT 5. The operating conditions and processing parameters for the trials with BELT 5 are shown in TABLE 8.

Four trials were conducted using BELT 6 using a papermaking machine configuration similar to that shown in FIG. 1. For the first set of trials, 80% Naheola SSWK/20% Naheola SHWK were used in a homogeneous mode. The basis weight will be targeted at 16.8 lb/rm for Trial 1, 21.0 lb/rm for Trial 2, and 25.5 lb/rm for Trial 3. No debonder was added to the stock. Fabric crepe and reel crepe were set at 20% and 2% while the sheet moisture prior to the suction box was set at normal condition (i.e., about 57%). To ensure adequate Yankee adhesion, KL506 PVOH was used as part of the Yankee coating adhesive. The target basesheet CD wet tensile (600 g/in$^3$) was achieved by balancing refining and add-ons of wet strength resin and CMC. The initial refining setting was set at 45 HP with the initial usages of wet strength resin and CMC at 25 and 5 lb/ton, respectively. To achieve the target CD wet tensile strength, the refining was adjusted. If the uncalendered caliper dropped below 160 mils/8-ply and target CD wet tensile was still not achieved by increased refining, more wet strength resin and CMC (at a ratio of 2:1) was added to achieve the target CD wet tensile strength. The dry tensile strength was allowed to float. Two (2) uncalendered rolls were collected in each trial.

TABLE 8

| | Trial 1 | Trial 2 |
|---|---|---|
| Furnish Blend | | |
| Yankee-SideLayer | 100% NSWK, unrefined | 100% Naheola SWK, unrefined |
| Air-Side Layer | 100% NSWK, refined | 100% Naheola SWK, refined |
| Furnish Split | 35/65 Yankee/Air | 35/65 Yankee/Air |
| Refining of Air Layer (Hp) | ~45 | ~45 |
| Debonder, lb/ton | 3.0 | 3.0 |
| Control of Wet Strength | WSR 25 lb/ton CMC 5 lb/ton | WSR 25 lb/ton CMC 5 lb/ton |
| Control of Wet/Dry Ratio | 3.0 lb/ton debonder | 3.0 lb/ton debonder |
| Fabric Crepe/Reel Crepe | 20%/2% | 20%/2% |
| Yankee Speed (fpm) | 1600 | 1600 |
| Molding Box Vac. (in. Hg) | 23.7 or max. | 23.7 or max |
| Creping Chemistry | Use PVOH and other normal coating components | Use PVOH and other normal coating components |
| Crepe Moisture | ~2% | ~2% |
| Parent Roll Needed | 10 calendered rolls and 2 uncalendered rolls | 10 calendered rolls and 2 uncalendered rolls |
| Basis Weight (lb/rm) | 16.8 | 16.8 |
| Caliper (mils/8-ply) | 125 | 125 |
| MD Tensile (g/3") | 1570 | 1570 |
| CD Tensile (g/3") | 1570 | 1570 |
| CD Wet Tensile (g/3") | 550 | 550 |
| Wet/Dry Ratio | 0.35 | 0.35 |
| Parent Rolls Calendered | 10 | 10 |
| Parent Rolls Uncalendered | 2 | 2 |

The next set of trials with BELT 6 was similar to the first set of trials, except with respect to creping speed. The basis weight was fixed at 25.5 lb/rm or at the basis weight that yielded the highest basesheet caliper. No debonder was added in the stock. The fabric crepe targets were 10% for Trial 4, 15% for Trial 5, and 20% for Trial 6. The reel crepe was set at 2% while the sheet moisture prior to the suction box was set at normal condition (i.e., about 57%). To ensure adequate Yankee adhesion, PVOH was used as part of the Yankee coating adhesive. The target basesheet CD wet tensile (600 g/3") was achieved by balancing refining and add-ons of wet strength resin and CMC. The initial refining setting was set at 45 HP with the initial usages of wet strength resin and CMC at 25 and 5 lb/ton, respectively. To achieve the target CD wet tensile strength, the refining was adjusted first. If the uncalendered caliper dropped below 160 mils/8-ply and target CD wet tensile was still not achieved by increased refining, more wet strength resin and CMC (at a ratio of 2:1) was added to achieve the target CD wet tensile strength. The dry tensile strength was allowed to float. Two uncalendered rolls were collected in each trial.

The next set of trials with BELT 6 was similar to the first set of trials, except with respect to sheet moisture. The basis weight was fixed at 25.5 lb/rm or at the basis weight that yielded the highest basesheet caliper. No debonder was added in the stock. Fabric crepe and reel crepe were set at 20% and 2%, respectively. The sheet moisture prior to the suction box was set at normal condition (i.e., about 57%) for Trial 7, 59% for Trial 8, and 61% for Trial 9 (Table 3). The sheet moisture was adjusted by setting an ADVANTAGE™ VISCONIP™ by Metso Oyj of Helsinki, Finland, load (i.e., 550 psi, 325 psi, and 200 psi) or adding a water spray before the creping roll. To ensure adequate Yankee adhesion, PVOH was used as part of the Yankee coating adhesive. The target basesheet CD wet tensile (600 g/3") was achieved by balancing refining and add-ons of wet strength resin and CMC. The initial refining setting was 45 HP with the initial usages of wet strength resin and CMC at 25 and 5 lb/ton, respectively. To achieve the target CD wet tensile strength, the refining was adjusted first. If the uncalendered caliper dropped below 160 mils/8-ply and target CD wet tensile was still not achieved by increased refining, more wet strength resin and CMC (at a ratio of 2:1) was added to achieve the target CD wet tensile strength. The dry tensile strength was allowed to float. Two uncalendered rolls will be collected in each trial.

In a final set of trials with BELT 6, the best combination of basis weight, fabric crepe, and sheet moisture prior to the suction box was selected to produce the best 1-ply basesheet that had a 160 mils/8-ply caliper, 600 g/in$^3$ CD wet tensile, 20% MD stretch. Ten parent rolls were collected for converting into 1-ply towel.

The operating conditions and processing parameters for the trials with BELT 6 are shown in TABLE 9.

TABLE 9

| Furnish Blend | |
|---|---|
| Yankee-SideLayer | 80/20 Naheola SWK/HWK, refined |
| Air-Side Layer | 80/20 Naheola SWK/HWK, refined |
| Furnish Split | 35/65 Yankee/Air |
| Refining of All Layers (Hp) | ~45 |
| Debonder, lb/ton | 0 |
| Control of Wet Strength | WSR 25 lb/ton<br>CMC 5 lb/ton (adjust when needed) |
| Control of Wet/Dry Ratio | N/A |
| Fabric Crepe/Reel Crepe | 10%, 15%, 20% (Trial 2)/2% |

TABLE 9-continued

| | |
|---|---|
| Yankee Speed (fpm) | 1600 |
| Molding Box Vac. (in. Hg) | 23.7 or max |
| Creping Chemistry | Use KL506 PVOH and other normal coating components |
| Sheet Moisture Prior to MB | 57%, 59%, 61% (Trial 3) |
| Crepe Moisture | ~2% |
| Parent Roll Needed | 2 uncalendered rolls (Trial 1-3)<br>10 uncalendered rolls (Trial 4) |
| Basis Weight (lb/rm) | 16.8, 21, 25.5 (Trial 1) |
| Caliper (mils/8-ply) | 160+ |
| MD Tensile (g/3") | 2400 |
| CD Tensile (g/3") | 2400 |
| CD Wet Tensile (g/3") | 600+ |
| Wet/Dry Ratio | 0.25+ |

Figure 14:
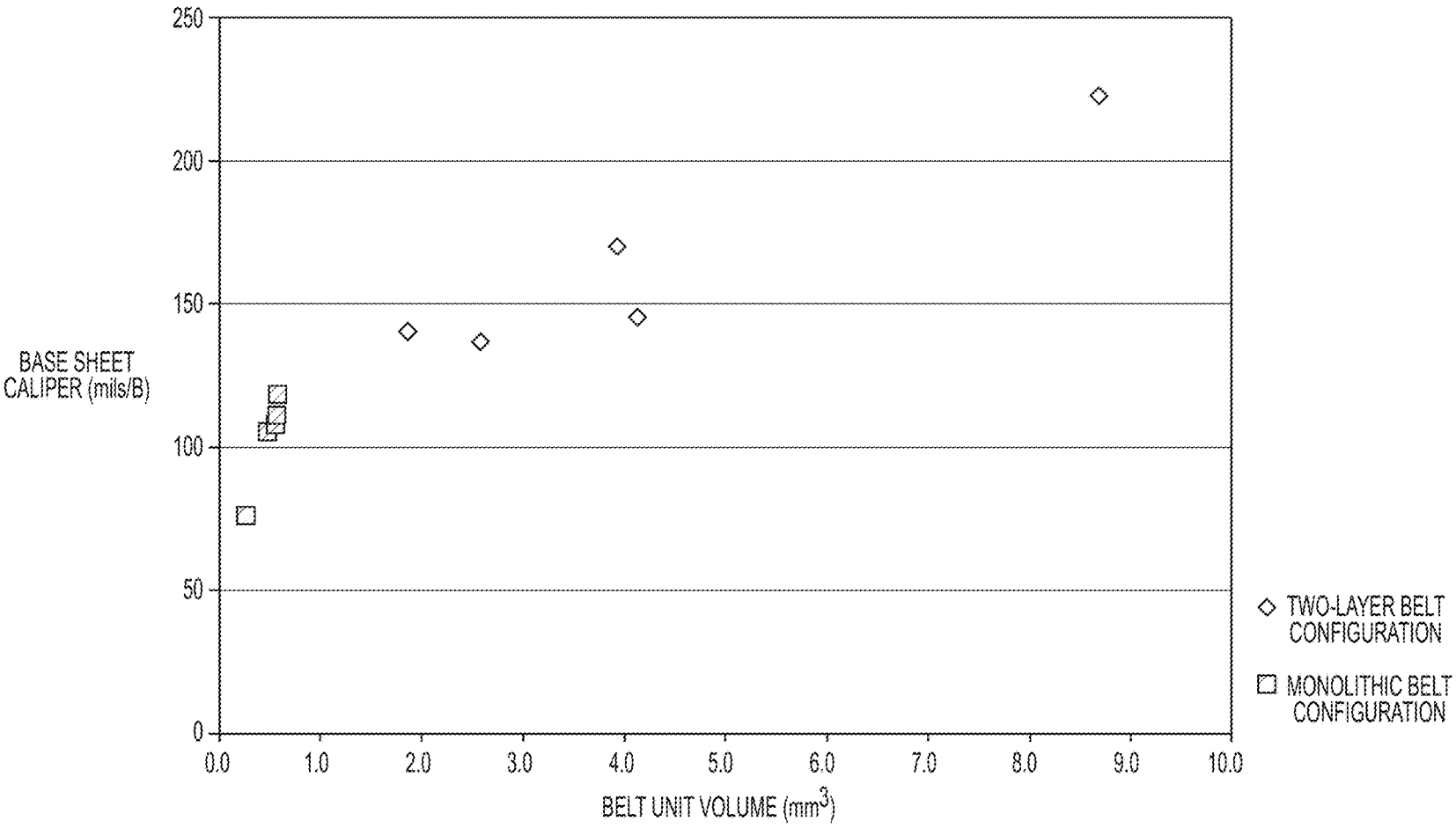
FIG. 14 is a plot of the relation between caliper of paper products according to the invention and the volume of openings in a multilayer belt structural configuration according to the invention.

Data from the trials with BELTS 1 and 3 to 6 and the structuring fabric are shown in FIG. 13. The results demonstrate the excellent combination of GM tensile and caliper for the paper products that were produced in the trials using multilayer belts. Specifically, the results show that the products made with BELTS 3 to 5 had calipers at least about 245 mils/8-ply. The products made by BELTS 3 to 6 had GM tensiles of less than about 3500 g/3 in. Of further note, the products produced using BELT 3 had calipers greater than about 270 mils/8-ply, and GM tensiles of less than about 3100 g/3 in., thus providing a particular good product in terms of both caliper and softness. The results shown in FIG. 14 also demonstrate the superiority of the paper products made with multilayer belts compared to products made with the fabric in terms of the combination of caliper and GM tensile. While the paper products produced using the fabric had a range of GM tensiles, none of the fabric-made paper products had a caliper significantly more than about 240 mils/8-ply. As discussed in detail above, paper products made using a multilayer belt allow for the formation of larger dome structures than can be produced using structuring fabrics. The larger dome structures in turn provide for more caliper in the paper products. Hence, as shown in FIG. 14, the multilayer belt made products had a higher caliper than the products made using the fabric.

In sum, the results shown in FIG. 13 demonstrate that the paper products of the invention, which can be made with the multilayer belts, had more caliper and more softness than the base sheets made with a structuring fabric. As those skilled in the art will certainly appreciate, caliper and softness are both important properties of many paper products. Thus, the paper products according to the invention include a very attractive combination of properties.

Basesheet and Converted Paper Properties

Further basesheets and finished products were made from BELTS 5 and 6, and the properties of these basesheets and finished products were determined. For these trials, the same general operating procedures were used as used in the softness and caliper trials with BELTS 5 and 6 described above. The furnish and calendering were varied in this series of trials, and the properties of the formed basesheets are shown in TABLE 10. Note that, in TABLE 10, the T1 furnish refers to a 100% NSWK furnish, and T2 furnish refers to a 80% Naheola SSWK/20% Naheola SHWK furnish.

TABLE 10

| Belt/Trial | 5/1 | 5/2 | 5/3 | 5/4 | 6/1 | 6/2 |
|---|---|---|---|---|---|---|
| Furnish | T1 | T1 | T2 | T2 | T2 | T2 |
| Calendering | Yes | No | Yes | No | Yes | No |
| Basis Weight (lbs/ream) | 17.04 | 16.59 | 16.99 | 16.88 | 16.76 | 16.50 |
| Caliper (mils/8 sheets) | 121.5 | 145.4 | 126.0 | 147.3 | 130.7 | 155.9 |
| MD Tensile (g/3 in.) | 1612 | 1337 | 1656 | 1409 | 1778 | 1665 |
| CD Tensile (g/3 in.) | 1553 | 1419 | 1607 | 1498 | 1574 | 1534 |
| GM Tensile (g/3 in.) | 1581 | 1377 | 1631 | 1452 | 1637 | 1598 |
| MD Stretch (%) | 28.5 | 28.6 | 28.0 | 26.5 | 26.1 | 23.7 |
| CD Stretch (%) | 9.3 | 9.4 | 9.2 | 8.5 | 7.3 | 6.8 |
| CD Wet Tensile - Finch (g/in$^3$) | 510 | 502 | 541 | 595 | 613 | 575 |
| CD Wet/Dry Finch (%) | 32.9 | 35.3 | 33.7 | 39.7 | 39.0 | 37.5 |
| GM Break Modulus (g/%) | 98.0 | 84.6 | 101.2 | 96.7 | 121.5 | 125.3 |

As a further aspect of this series of trials, the basesheets shown in TABLE 10 were converted to finished paper towel products. The conversion process included embossing using the emboss pattern shown in U.S. Design Pat. No. 648,137 (the disclosure of which is incorporated by reference in its entirety) in THVS mode at a sheet count of 52 and a sheet length of 0.14 inches. For the trial marked 4/1, the emboss penetration varied from about 0.065 to about 0.072 inches. For the other trials in TABLE 10, the emboss penetration was set at 0.070 inches. The marrying roll nip width was set at 13 mm for all of the trials, and the trial basesheets were made using perforation blades having a 0.019 in. bond width by 27 bonds/blade. The properties of the converted, finished products are shown in TABLE 11.

TABLE 11

| Belt/Trial | 4/1 | 4/2 | 4/3 | 4/4 | 5/1 | 5/2 |
|---|---|---|---|---|---|---|
| Basis Weight (lbs/ream) | 34.46 | 33.16 | 33.63 | 33.01 | 32.97 | 32.59 |
| Caliper (mils/8 sheets) | 224.0 | 266.0 | 237.6 | 266.5 | 239.4 | 292.0 |
| MD Tensile (g/3 in.) | 3414 | 2930 | 3303 | 3125 | 3618 | 3436 |
| CD Tensile (g/3 in.) | 3058 | 2744 | 3032 | 2952 | 3098 | 2779 |
| GM Tensile (g/3 in.) | 3231 | 2836 | 3164 | 3037 | 3346 | 3089 |
| MD Stretch (%) | 27.0 | 26.6 | 24.2 | 24.1 | 23.0 | 22.5 |
| CD Stretch (%) | 9.5 | 9.7 | 9.2 | 9.1 | 7.8 | 7.3 |
| CD Wet Tensile - Finch (g/in$^3$) | 940 | 859 | 922 | 963 | 1034 | 928 |
| CD Wet/Dry - Finch (%) | 30.7 | 31.3 | 30.4 | 32.6 | 33.4 | 33.4 |
| Perf. Tensile (g/in$^3$) | 713 | 666 | 750 | 683 | 798 | 672 |
| SAT Capacity (g/m$^2$) | 434 | 455 | 442 | 474 | 405 | 407 |
| SAT Capacity (g/g) | 7.7 | 8.4 | 8.1 | 8.8 | 7.6 | 7.7 |
| SAT Rate (g/sec$^{0.5}$) | 0.11 | 0.09 | 0.11 | 0.11 | 0.07 | 0.05 |
| GM Break Modulus (g/%) | 202.6 | 175.5 | 213.0 | 204.4 | 250.8 | 240.9 |
| GM Tensile Modulus (g/in/%) | 43.4 | 38.2 | 48.3 | 43.6 | 53.3 | 51.7 |
| Roll Diameter (in) | 4.91 | 5.27 | 5.03 | 5.27 | 5.14 | 5.59 |
| Roll Compression (%) | 9.5 | 9.8 | 9.8 | 7.7 | 11.2 | 10.3 |
| Sensory Softness | 10.42 | 10.33 | 9.05 | 9.07 | 6.94 | 6.64 |

Most of the properties of the finished paper towel products shown in TABLE 11 are equivalent to or exceed those of currently-available paper towels. Of note, however, was that the caliper of the paper towels, in general, greatly exceeds that of currently offered paper towels. As generally discussed above, the caliper of a paper product is inversely proportional to softness. While the softness and absorbency of the finished paper towel products are shown in TABLE 11, as indicated by the Sensory Softness, GM Tensile, and SAT capacities, was slightly less than the softness of other paper towel products, the softness was nevertheless very good given the very large caliper of the products. Also of note was the GM Break Modulus of the finished paper towel products. The GM Break Modulus of a paper product is a good indicator of the strength of the product. The finished paper towel products shown in TABLE 9 exhibited an excellent GM Break Modulus.

Paper Properties in Relation to Belt Properties

In another series of tests, the effect of various properties of belt materials on paper products was determined. In the first series of trials, the effect of the volume of the openings in multilayer belt materials according to the invention on the caliper generated in towel grade products was determined. The results were also compared to the effect of the volume of openings in monolithic (polymeric) belt configurations in forming towel grade products. As noted above, a towel grade product generally has a basis weight of about 33 lbs/ream and a caliper of about 225 mils/8 sheets. For these trials, the basesheets were formed using multilayer belt materials according to the invention, and paper towel grade basesheets were formed using a monolithic belt material. The multilayer belt materials had openings in the top surface of the top layer that ranged from about 2.0 mm$^3$ to about 9.0 mm$^3$. The monolithic belt materials had openings of less than about 1.0 mm$^3$. Note that the sizes of the openings in the multilayer belt materials and the monolithic belt materials were consistent with the disclosure above indicating that a multilayer belt structure allows for larger openings than a monolithic belt structure. That is, the openings in the multilayer belt materials were made larger given that large openings could not be formed in a monolithic belt structure that is actually used in a papermaking process. This series of trials was conducted in a laboratory on a pilot paper machine with the processing conditions, as generally described above.

FIG. 14 shows the results of the tests in terms of the caliper of the towel grade base sheets that were generated relative to the volume of the openings in the top layer of the multilayer and monolithic belts. As can be seen from the Figure, a higher caliper was generated using the multilayer belt material than the caliper that was generated using the monolithic belt materials. These results demonstrate that a large volume of openings in the belt structure may lead to more caliper in towel grade products. Of particular note is that the multilayer belt material having a configuration with openings of about 9.0 $mm^3$ generated a caliper of about 220 mils/8 sheets, which was nearly 100 mils/8 sheets greater than any of the calipers generated using the monolithic belts. As one of ordinary skill in the art will certainly appreciate, the tremendously large caliper generated by this multilayer belt material could be used to produce an extremely attractive towel product.

In another series of tests, the effect of the volume of the openings in multilayer belts according to the invention on the caliper generated in tissue grade products was determined. The results were also compared to the effect of the volume of openings in monolithic (polymeric) belt configurations in forming tissue grade products. As noted above, a tissue grade product generally has a basis weight of about 27 lbs/ream and a caliper of about 140 mils/8 sheets. For these tests, the basesheets were formed in a laboratory using multilayer belt materials according to the invention, and paper tissue grade basesheets were formed in a laboratory using a monolithic belt material. The multilayer belt materials had configurations with openings in the top surface of the top layer that ranged from about 1.5 $mm^3$ to about 5.5 $mm^3$. The monolithic belt materials had configurations with openings of less than about 1.0 $mm^3$. Note that the sizes of the openings in the multilayer belt materials and the monolithic belt materials were consistent with the disclosure above indicating that a multilayer belt structure allows for larger openings than does a monolithic belt structure. This series of trials was conducted in a laboratory on a pilot paper machine with the processing conditions, as generally described above.

Figure 15:
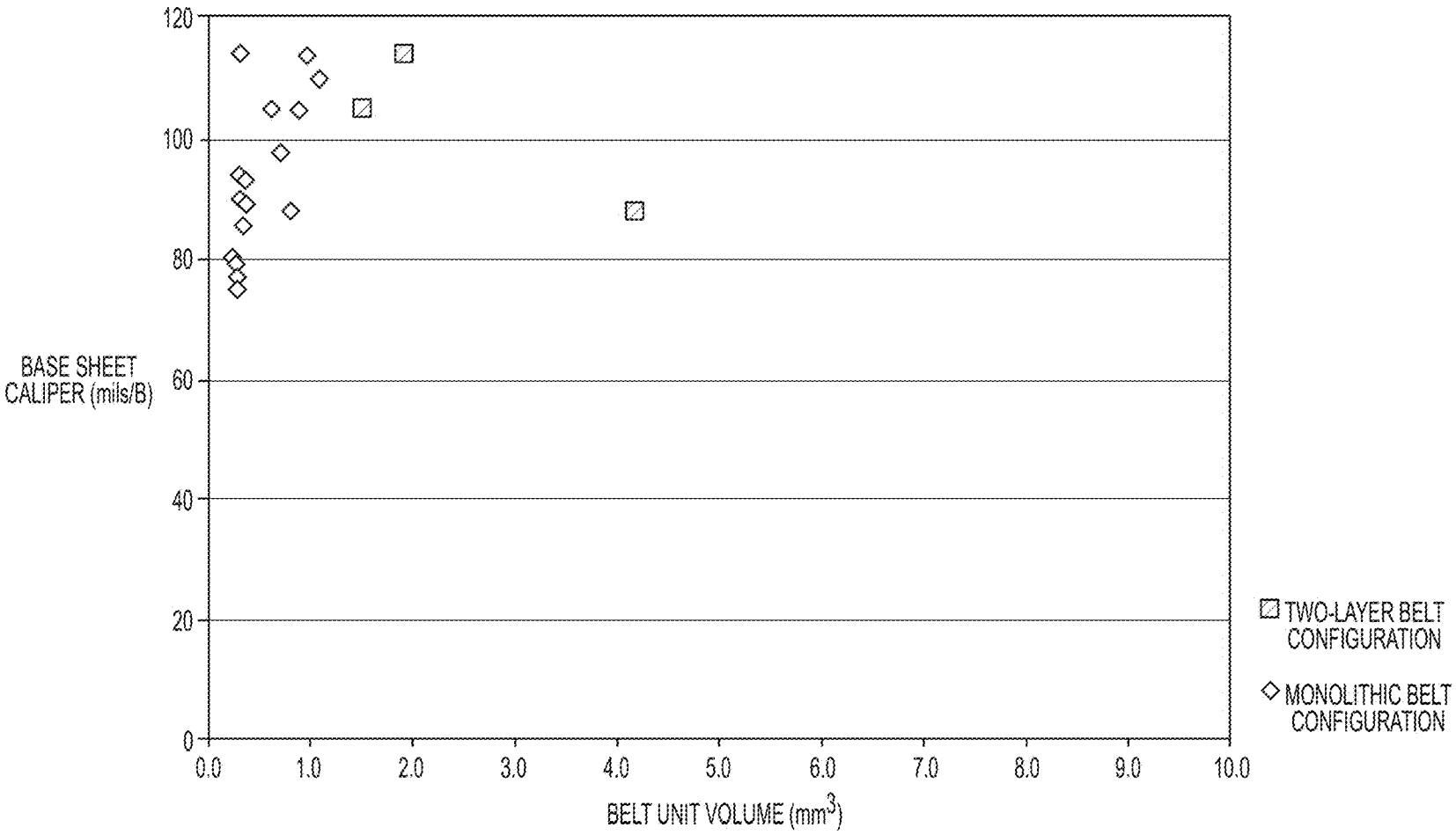
FIG. 15 is a plot of the relation between caliper of paper products according to the invention and the volume of openings in a multilayer belt structural configuration according to the invention.

The results of these tests are shown in FIG. 15. As can be seen from the Figure, the multilayer belt materials, which had the larger openings, could produce tissue grade base sheets having a caliper comparable to that of the caliper that was found in the tissue grade base sheets made using the monolithic layer belt materials. While the multilayer belt material did not provide an increased caliper as seen with the towel grade tests (FIG. 14), the multilayer belt materials nonetheless may be advantageous in forming tissue grade products. For example, as noted above, the larger openings that can be provided by a multilayer belt configuration allow for a greater fiber density within the dome structures in the product. Further, the multilayer belt structure, while producing a comparable tissue grade caliper as a monolithic, may be stronger and more durable than a monolithic structure for all of the reasons discussed above. Thus, even if the tissue grade caliper that is generated with a multilayer belt structure is in the same range as the caliper that is generated using a monolithic belt structure, the multilayer belt structure may nevertheless have certain advantages when used in tissue grade paper making processes.

In yet another series of tests, different multilayer creping belt materials having different opening sizes were used to generate towel grade products. Four belt materials were tested, with the belt materials having circular openings in the top layer in the manner described above. Belt Material A had a 1.0 mm polyurethane top layer attached to a 0.5 mm PET bottom layer, Belt Material B had a 0.5 mm polyurethane top layer attached to a 0.5 mm PET bottom layer, Belt Material C had a 0.5 mm polyurethane top layer and a fabric bottom layer, and Belt Material D had a 1.0 mm polyurethane top layer and a fabric bottom layer. For each type of belt material, configurations with openings of different sizes were tested, with the openings ranging from about 0.75 mm to about 2.25 mm in diameter. This series of trials was conducted in a laboratory using vacuum sheet molding, which simulates a papermaking process (without actually conducting a creping operation).

Figure 16:
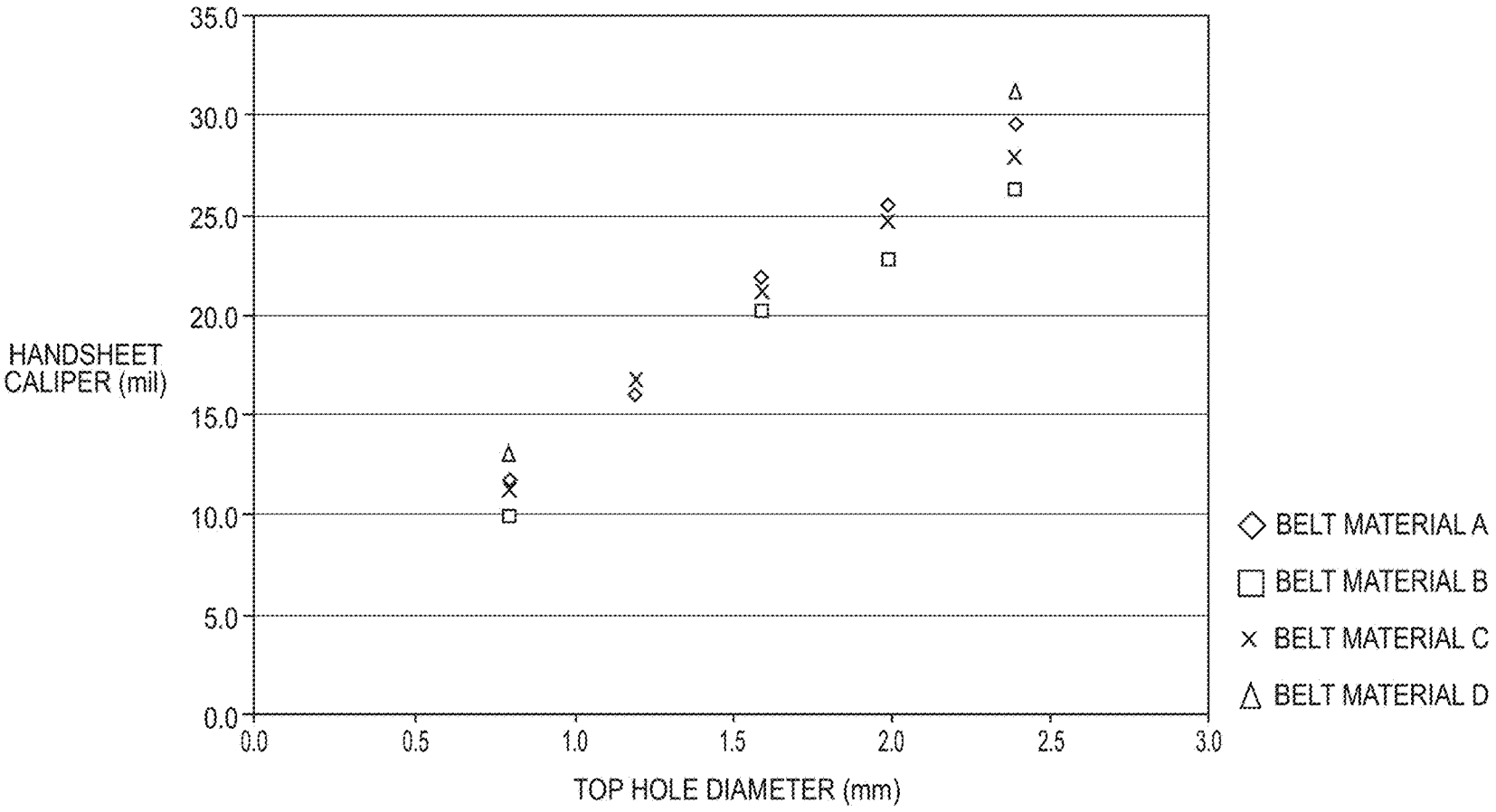
FIG. 16 is a plot of the relation between caliper of paper products according to the invention and the diameter of openings in a multilayer belt structural configuration according to the invention.

The results of these tests are shown in FIG. 16, which shows the relation between the top opening (hole) diameter and the caliper generated for each of the belt materials. As can be seen from the figure, as the opening size in each belt material increased, the caliper of the resulting paper product made with the belt material increased. This is once again consistent with the disclosure above indicating that, as the opening size in the top layer of a multilayer belt is increased, a greater caliper can be generated, at least with respect to towel grade products. The data in the figure also demonstrate that different thicknesses for the multilayer belt structure may produce relatively comparable caliper in paper products, with a 1.0 mm top layer sometimes producing slightly more caliper than does a 0.5 mm top layer.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The apparatuses, processes, and products described herein can be used for the production of commercial paper products, such as toilet paper and paper towels. Thus, the apparatuses, processes, and products have numerous applications related to the paper product industry.

We claim:

1. A method of creping a cellulosic sheet, the method comprising:

(a) forming a nascent web from an aqueous papermaking furnish;

(b) depositing and creping the nascent web on a multilayer creping belt that includes (i) a first layer made from a polymeric material having a plurality of openings, and (ii) a second layer that is separate from and attached to a surface of the first layer, with the nascent web being deposited on the first layer; and (c) applying a vacuum to the creping belt such that the nascent web is drawn into the plurality of openings, after the nascent web is deposited on the multilayer creping belt.

2. A method according to claim 1, wherein the nascent web is deposited on the creping belt at about 30% solids to about 60% solids content.

3. A method according to claim 1, wherein the nascent web is deposited on the creping belt at about 15% solids to about 25% solids content.

4. A method according to claim 1, further comprising applying a vacuum as the nascent web is being deposited on the creping belt, in addition to the vacuum that draws the nascent web into the plurality of openings.

5. A method according to claim 4, wherein the vacuum applied as the nascent web is being deposited on the creping belt is about 5 in. Hg to about 30 in. Hg.

6. A method according to claim 1, wherein the second layer is configured to limit a majority of the fibers from passing completely through the multilayer creping belt.

7. A method according to claim 1, wherein the polymeric material of the first layer is a polyurethane, and the second layer is made from a polyethylene terephthalate fabric.

8. A method according to claim 1, wherein the depositing step includes depositing the nascent web from a transfer surface onto the creping belt.

9. A method according to claim 8, wherein the transfer surface moves at a transfer surface speed and the creping belt moves at a creping belt speed, the transfer surface speed being greater than the creping belt speed.

10. A method according to claim 1, wherein the first layer is made from an extruded polymeric material.

11. A method of creping a cellulosic sheet, the method comprising:

(a) forming a nascent web from an aqueous papermaking furnish;

(b) depositing and creping the nascent web on a multilayer creping belt that includes (i) a first layer made from a polymeric material having a plurality of openings, and (ii) a second layer that is made from a fabric, the second layer being separate from and attached to a first surface of the first layer, the nascent web being deposited on a second surface of the first layer that is opposite to the first surface; and (c) applying a vacuum to the creping belt such that the nascent web is drawn into the plurality of openings.

12. A method according to claim 11, wherein the nascent web is deposited on the creping belt at about 30% solids to about 60% solids content.

13. A method according to claim 11, wherein the nascent web is deposited on the creping belt at about 15% solids to about 25% solids content.

14. A method according to claim 11, further comprising applying a vacuum as the nascent web is being deposited on the creping belt, in addition to the vacuum that draws the nascent web into the plurality of openings.

15. A method according to claim 14, wherein the vacuum applied as the nascent web is being deposited on the creping belt is about 5 in. Hg to about 30 in. Hg.

16. A method according to claim 11, wherein the second layer is configured to limit a majority of the fibers from passing completely through the multilayer creping belt.

17. A method according to claim 11, wherein the polymeric material of the first layer is a polyurethane, and the fabric of the second layer is made from a polyethylene terephthalate.

18. A method according to claim 11, wherein the depositing step includes depositing the nascent web from a transfer surface onto the creping belt.

19. A method according to claim 18, wherein the transfer surface moves at a transfer surface speed and the creping belt moves at a creping belt speed, the transfer surface speed being greater than the creping belt speed.

20. A method according to claim 11, wherein the first layer is made from an extruded polymeric material.

* * * * *